US008590448B2

(12) United States Patent
Swisher et al.

(10) Patent No.: US 8,590,448 B2
(45) Date of Patent: Nov. 26, 2013

(54) SELF-ALIGNING STENCIL DEVICE AND METHOD OF PRODUCING A MULTI-COLOR COMPOSITE IMAGE

(75) Inventors: John G. Swisher, Mahwah, NJ (US); Janna Makaeva, Mahwah, NJ (US)

(73) Assignee: Innovative Art Concepts, LLC, Dayton, NJ (US)

( * ) Notice: Subject to any disclaimer, the term of this patent is extended or adjusted under 35 U.S.C. 154(b) by 400 days.

(21) Appl. No.: 13/011,654

(22) Filed: Jan. 21, 2011

(65) Prior Publication Data

US 2011/0174172 A1 Jul. 21, 2011

Related U.S. Application Data

(60) Provisional application No. 61/297,117, filed on Jan. 21, 2010.

(51) Int. Cl.
*B41N 1/24* (2006.01)

(52) U.S. Cl.
USPC ..... 101/127; 101/129; 101/115; 434/87

(58) Field of Classification Search
USPC ..... 101/127, 115, 129; 434/87
See application file for complete search history.

(56) References Cited

U.S. PATENT DOCUMENTS

| | | | | |
|---|---|---|---|---|
| 2,066,477 | A | 1/1937 | Levin | |
| 4,205,849 | A | 6/1980 | Perkins | |
| 4,931,017 | A | 6/1990 | Mann | |
| 5,222,303 | A * | 6/1993 | Jardine | 33/528 |
| 5,243,905 | A | 9/1993 | Webber | |
| 5,482,295 | A | 1/1996 | Phelan | |
| 5,992,316 | A | 11/1999 | Komata et al. | |
| 6,217,336 | B1 | 4/2001 | Matthews | |
| 7,156,017 | B1 | 1/2007 | Ingraselino | |
| 7,347,142 | B2 * | 3/2008 | Fields et al. | 101/129 |
| 2003/0205152 | A1 | 11/2003 | Houtzer | |
| 2004/0096807 | A1 | 5/2004 | McGannon | |
| 2004/0123477 | A1 | 7/2004 | Kauth | |
| 2007/0164553 | A1 | 7/2007 | Katz et al. | |
| 2010/0275796 | A1 * | 11/2010 | Lee | 101/127 |

OTHER PUBLICATIONS

International Search Report and Written Opinion issued in PCT/US2011/022122, mailed Oct. 27, 2011.

* cited by examiner

*Primary Examiner* — Leslie J Evanisko
(74) *Attorney, Agent, or Firm* — Heslin Rothenberg Farley & Mesiti P.C.; Andrew K. Gonsalves, Esq.

(57) ABSTRACT

The present invention relates to a self-aligning stencil device for producing a multi-color composite image on a target surface. The self-aligning stencil device includes a central panel and a plurality of stencil panels foldably connected to the central panel. The central panel includes a solid region and a cut-out region. The solid region of the central panel includes a front surface and a back surface, and is defined by an outer border of the central panel and an inner border of the central panel. The cut-out region is vacant space that is defined by the inner border of the central panel. Each stencil panel has its own distinct stencil pattern and is foldably connected to a different corresponding portion of the outer border of the central panel, thereby forming a connection fold between each stencil panel and its corresponding portion of the outer border of the central panel. The plurality of stencil panels, when folded at their connection folds upon the central panel, self-align to collectively form a composite image, so that painting each distinct stencil pattern with a different color is effective to yield a multi-color composite image on a region of the surface imposed behind the cut-out region of the central panel. Also disclosed are kits and methods for producing multi-color composite images using the device of the present invention.

44 Claims, 19 Drawing Sheets

THREE-PLATE VERSION OF THE FOLDING STENCIL

TWO-PLATE VERSION OF FOLDING STENCIL.
PLATE 2 FOLDS OVER PLATE 1 TO ADD HIGHLIGHTS OF A DIFFERENT COLOR

SELF-ALIGNING STENCIL DEVICE AND METHOD OF PRODUCING A MULTI-COLOR COMPOSITE IMAGE

CROSS-REFERENCE TO RELATED APPLICATIONS

This application claims priority benefit of U.S. Provisional Patent Application Ser. No. 61/297,117, filed Jan. 21, 2010, the disclosure of which is hereby incorporated by reference herein in its entirety.

FIELD OF THE INVENTION

The present invention relates to a self-aligning stencil device for producing multi-color and multi-layered images on various target surfaces. The present invention also relates to kits that include the self-aligning stencil device and methods of using the self-aligning stencil device to produce multi-color composite images on a target surface.

BACKGROUND OF THE INVENTION

Stencils have been used over the years to draw and paint images on surfaces such as paper, walls, and woodwork. However, to date, such stencils are limited in the type of surfaces to which they can be applied and are often cumbersome to use. Further, the stencils currently available are limited in the type of image that can be produced. Most stencils use a single plate or plane to produce images that are of a single color. Unfortunately, current stencils that are able to produce a multi-color image are not able to produce high quality or artistic stylized images. Still other multi-color stencils are limited in that they can only produce images on a sheet of paper, as opposed to various other surfaces such as walls or ceilings. Further, there is a need for a stencil that can produce multi-color, multi-layered images in a repeatable fashion, particularly with regard to the placement and alignment of the stenciled image on a desired surface. The present invention is directed to overcoming these and other deficiencies in the art.

SUMMARY OF THE INVENTION

In one aspect, the present invention relates to a self-aligning stencil device for producing a multi-color composite image on a target surface. The self-aligning stencil device includes a central panel and a plurality of stencil panels foldably connected to the central panel. The central panel includes a solid region and a cut-out region. The solid region of the central panel includes a front surface and a back surface, and is defined by an outer border of the central panel and an inner border of the central panel. The cut-out region is vacant space that is defined by the inner border of the central panel. Each stencil panel has its own distinct stencil pattern and is foldably connected to a different corresponding portion of the outer border of the central panel, thereby forming a connection fold between each stencil panel and its corresponding portion of the outer border of the central panel. The plurality of stencil panels, when folded at their connection folds upon the central panel, self-align to collectively form a composite image, so that painting each distinct stencil pattern with a different color is effective to yield a multi-color composite image on a region of the surface imposed behind the cut-out region of the central panel. In one embodiment, the self-aligning stencil device of the present invention can further include an attachment component for removably securing the central panel in a desired position on a surface, where the attachment component is indirectly or directly attached to the central panel. In another embodiment, the attachment component can be a securing panel foldably connected to the upper most portion of the outer border of the central panel, where the securing panel includes an outer surface and an opposing inner surface that folds toward the central panel.

In another aspect, the present invention relates to a kit for producing a multi-color composite image on a target surface. The kit includes a self-aligning stencil device of the present invention and painting supplies for use in applying paint to a surface. In various embodiments, other components may be added to the kit of the present invention. For example, the kit can include a clip-on stencil level that can be used as part of the self-aligning stencil device in order to direct the placement of the stencil device on the target surface prior to painting. Also, the kit can include a foam applicator cap suitable for attaching to a paint bottle and for applying paint to the target surface.

In a further aspect, the present invention relates to a method of producing a multi-color image to a surface. In one embodiment, the method involves providing a self-aligning stencil device according to the present invention (this step being referred to herein as "Step (1)"). The central panel is then temporarily secured, either directly or indirectly, to a surface to which the multi-color image is to be produced thereon, so that each of the stencil panels is in an unfolded position (this step being referred to herein as "Step (2)"). Paint is then applied to the surface using a first stencil panel as follows: (i) folding a first stencil panel onto the central panel; (ii) applying a first paint color to the surface as defined by the first stencil panel; and (iii) unfolding the first stencil from the central panel (this step being referred to herein as "Step (3)"). Step (3) is then repeated for each of the remaining stencil panels until the desired final multi-color image is produced on the surface (this step being referred to herein as "Step (4)").

Therefore, the present invention provides, inter alia, a self-aligning stencil device that is effective for facilitating multi-color and multi-layer stenciling using paints and the like, for walls, ceilings, woodwork, paper, tiles, canvas, and similarly related surfaces. The self-aligning stencil device of the present invention enables a person with limited or no artistic ability to produce beautiful and consistent works of art for decorative and amusement purposes.

The unique design of the stencil device of the present invention involves, in one embodiment, folding flaps (referred to herein as "stencil panels") over an open backed center section (referred to herein as the "central panel") to allow for stenciling over any surface. By way of contrast, products known in the relevant art have no open back, limiting the item to be stenciled to the thickness of paper and to the size of the stenciling device.

These and other objects, features, and advantages of this invention will become apparent from the following detailed description of the various aspects of the invention taken in conjunction with the accompanying drawings.

BRIEF DESCRIPTION OF THE DRAWINGS

For the purpose of illustrating aspects of the present invention, there are depicted in the drawings certain embodiments of the invention. However, the invention is not limited to the precise arrangements and instrumentalities of the embodiments depicted in the drawings. Further, as provided, like reference numerals contained in the drawings are meant to identify similar or identical elements.

FIG. 1A shows the stencil device in final form, while FIG. 1B shows the individual components of the stencil device. FIG. 1B also shows a view of the stencil device with its stencil panels and securing panel partially folded toward the central panel.

As shown in FIG. 5, one stencil panel is foldably attached to the left of the central panel, and the other stencil panel is foldably attached to the right of the central panel.

As shown in FIG. 6, plate 2 folds over plate 1 to enable the addition of highlights of a different color to the image. However, the present invention also contemplates folding plate 1 onto plate 2, with plate 2 being removably secured to the surface.

FIG. 8A shows illustration of various views of the leveling component (e.g., a clip-on stencil level), including a front view, a top view, a side view, an angled view, and a bottom view. FIGS. 8B and 8C are photographs of the leveling component (e.g., a clip-on stencil level) as used with a wall stencil.

FIG. 11A shows the embodiment in both the unfolded position and the completely folded position (for storage). In the embodiment shown in FIG. 11A, the stencil device includes color-coded numerical instructions on each of the stencil panels. For example, stencil panel number one has the numeral "1" in a yellow circle, indicating that this stencil panel should be painted first using the color yellow. Stencil panel number two has the numeral "2" in a blue circle, indicating that this stencil panel should be painted second using the color blue. Stencil panel number three has the numeral "3" in an orange circle, indicating that this stencil panel should be painted third using the color orange. Stencil panel number four has the numeral "4" in a green circle, indicating that this stencil panel should be painted fourth using the color green. Stencil panel number five has the numeral "5" in a black circle, indicating that this stencil panel should be painted fifth using the color black.

FIG. 12A shows the foam applicator tip and the paint bottle. FIG. 12B shows the foam applicator tip attached to the paint bottle. FIG. 12C shows the use of the foam applicator tip and paint bottle being used to apply green paint to the surface using the stencil device of the present invention.

DETAILED DESCRIPTION OF THE INVENTION

The present invention provides, inter alia, a self-aligning stencil device that is effective for facilitating multi-color and multi-layer stenciling using paints and the like for various surfaces. The stencil device of the present invention is effective for numerous types of surfaces, including, without limitation, surfaces such as walls, ceilings, woodwork, paper, tiles, canvas, and similarly related surfaces. The stencil device of the present invention enables a person with limited or no artistic ability to produce beautiful and consistent works of art for decorative and amusement purposes. The unique design of the stencil device of the present invention involves, in one embodiment, folding flaps over an open-backed center section to allow for stenciling over any surface. By way of contrast, products known in the art have no open back, often limiting the item to be stenciled to the thickness of paper and to the size of the stenciling device.

The present invention also relates to a kit containing the stencil device of the present invention. Various other components of the kit are set forth in the present specification.

The present invention further relates to a method of producing a multi-color composite image using the stencil device of the present invention. The method is further illustrated herein.

Figure 1A:
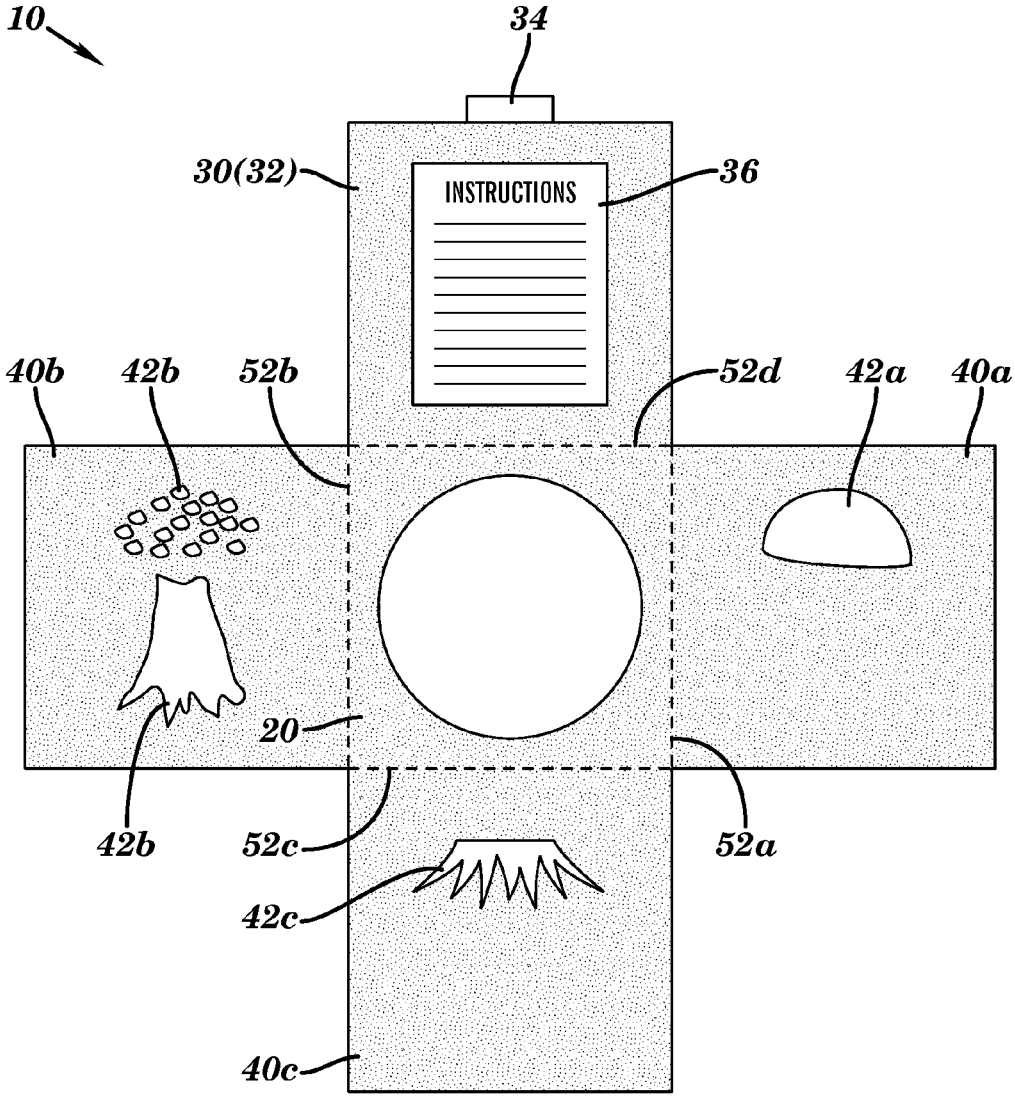
FIGS. 1A-1B are schematic illustrations showing one embodiment of the self-aligning stencil device of the present invention. The stencil device shown includes three stencil panels and an attachment component (also a securing panel) that also includes instructions.
Figure 1B:
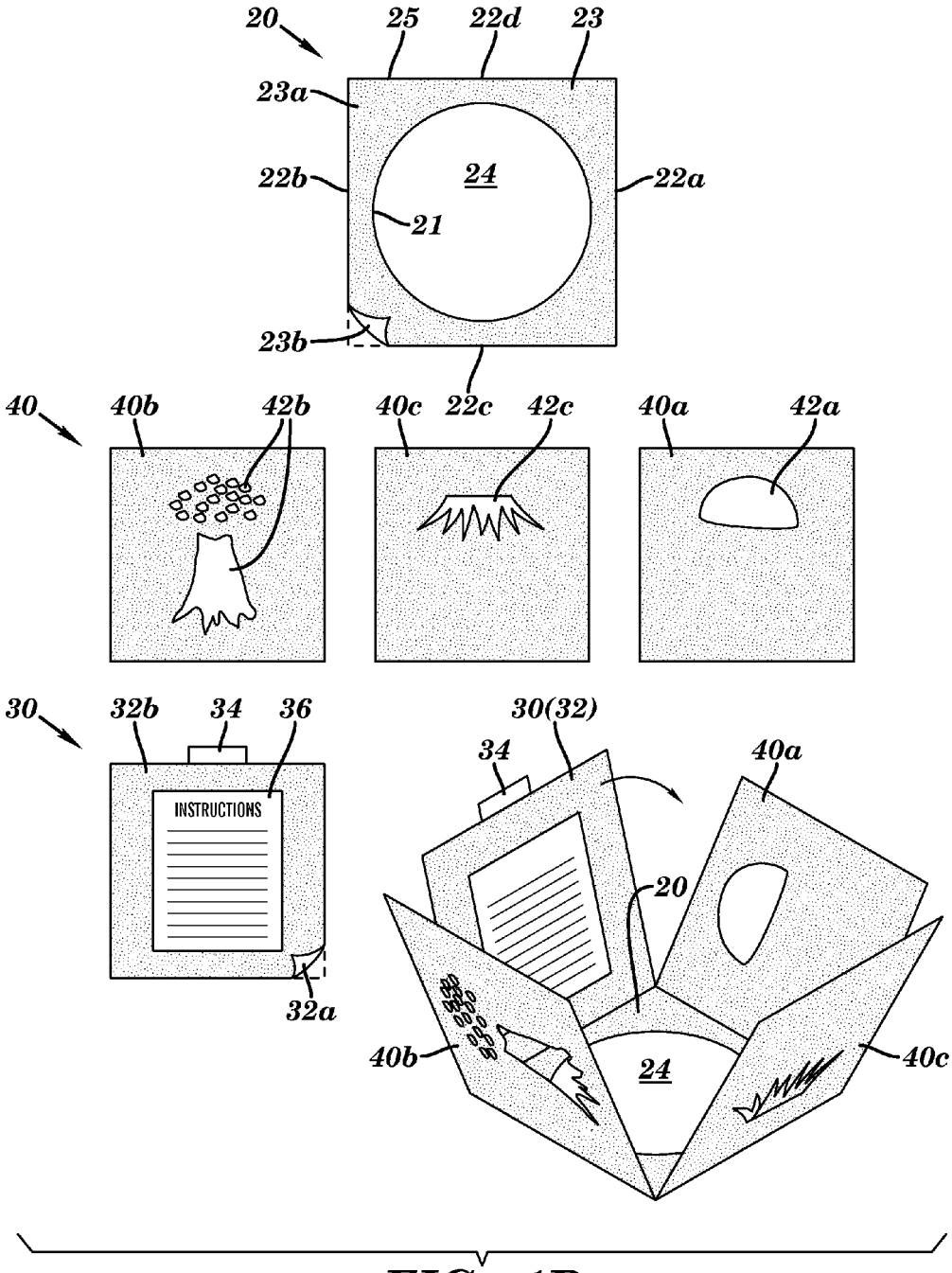

For purposes of illustrating the general aspects of the present invention, FIGS. 1A and 1B show one embodiment of the self-aligning stencil device of the present invention for producing a multi-color composite image on a target surface. FIGS. 1A and 1B provide an overview of certain aspects of the stencil device of the present invention, but the stencil device of the present invention is not limited to the aspects shown in FIGS. 1A and 1B.

As shown in FIG. 1A, in one embodiment, self-aligning stencil device 10 includes central panel 20 and a plurality of stencil panels 40 (depicted in FIG. 1A as 40*a*, 40*b*, and 40*c*) foldably connected to central panel 20. In a particular embodiment, self-aligning stencil device 10 can further include attachment component 30 (also depicted as 32) for removably securing central panel 20 in a desired position on a surface, where attachment component 30 is indirectly or directly (as in FIG. 1A) attached to central panel 20. As shown in FIGS. 1A and 1B, in another particular embodiment, attachment component 30 can be configured as securing panel 32 foldably connected to the upper most portion 25 (see FIG. 1B) of the outer border (depicted in FIG. 1B as 22*d*) of central panel 20, where securing panel 30 (also depicted as 32) includes outer surface 32*a* and opposing inner surface 32*b* that folds toward central panel 20. Securing panel 32 and central panel 20 are foldably connected at connection fold 52*d* (see FIG. 1A).

As shown in FIG. 1B, central panel 20 includes solid region 23 and cut-out region 24. Solid region 23 of central panel 20 includes front surface 23*a* and back surface 23*b*, and is defined by outer border 22 (depicted in FIG. 1B as 22*a*, 22*b*, 22*c*, and 22*d*) of central panel 20 and inner border 21 of central panel 20. Cut-out region 24 is vacant space that is defined by inner border 21 of central panel 20.

As shown in FIGS. 1A and 1B, each stencil panel 40 (depicted in FIGS. 1A and 1B as 40*a*, 40*b*, and 40*c*) has its own distinct stencil pattern as depicted in FIGS. 1A and 1B as stencil patterns 42*a*, 42*b*, and 42*c*, and is foldably connected to a different corresponding portion of outer border 22 (depicted in FIG. 1B as 22*a*, 22*b*, 22*c*, and 22*d*) of central panel 20, thereby forming a connection fold as depicted in FIG. 1A as 52*a*, 52*b*, and 52*c* between each stencil panel 40*a*, 40*b*, and 40*c* and its corresponding portion of outer border 22 (depicted in FIG. 1B as 22*a*, 22*b*, 22*c*, and 22*d*) of central panel 20.

As shown in FIG. 1A, the plurality of stencil panels 40, when folded at their connection folds 52 (depicted in FIG. 1A as 52*a*, 52*b*, and 52*c*) upon central panel 20, self-align to collectively form a composite image, so that painting each distinct stencil pattern with a different color is effective to yield a multi-color composite image on a region of the surface imposed behind the cut-out region of the central panel.

Although FIG. 1B shows central panel 20, securing panel 32, and the plurality of stencil panels 40 (depicted as 40*a*, 40*b*, and 40*c*) as separate panels, the stencil device can also be made so that all of these panels are constructed from a single large panel. For example, a one-unit stencil device can be cut from a single large panel of stencil material and foldable regions added to induce connection folds 52*a*, 52*b*, 52*c*, and 52*d*. The material used for making the panels can be of any type of material typically used for stencils, but it is not limited to such material. To add the foldable regions, indentations can be made along the desired folding area. The stencil patterns can be cut into the stencil panels, and cut-out region 24 can be cut to form central panel 20.

The self-aligning stencil device of the present invention can be used to paint any type of multi-color composite image onto a surface. This is achieved by including a central panel that has a cut-out region that exposes the target surface for painting. Each stencil panel is configured to have its own "distinct stencil pattern," so that painting each distinct stencil pattern with a different color of paint yields a multi-color composite image. As used herein, the term "distinct stencil pattern" refers to any stencil pattern that is cut into its own stencil panel. Although each stencil panel may have its own unique stencil pattern, the term "distinct stencil pattern" as used herein also refers to stencil patterns that are similar or the same, but on separate stencil panels. Thus, consistent with the above definition of the term "distinct stencil pattern," the present invention covers self-aligning stencil devices having more than one stencil panel that contains the same or similar stencil pattern, or portions of the same or similar stencil pattern.

In one embodiment, the stencil pattern of each stencil panel can be configured so that the multi-color composite image produced by painting each stencil pattern is also multi-layered. In a particular embodiment, at least two of the stencil patterns can be configured to have overlapping regions so that the multi-color composite image produced by painting each stencil pattern is shaded due to the mixing of colors. For example, the overlapping regions of the stencil patterns will be painted with different colors or different shades of the same colors to yield a shading effect or to produce a mixed color.

The central panel, each stencil panel, and the securing panel (discussed below) can be made of the same or different materials. Any material suitable for stenciling can be used, including the materials well known in the art for use in producing stencils. The central panel, each stencil panel, and the securing panel (discussed below) can have the same shape or different shapes. The shape chosen for each panel can depend on functional (e.g., foldability, closing, and packaging) and/or aesthetic objectives. Suitable shapes used for the panels of the present invention can include any shape, including, without limitation, the following shapes: a circle, an oval, an oblong shape, a triangle, a diamond shape, a star, a square, a rectangle, a pentagon, a hexagon, an octagon, an irregular shape, and the like.

Figure 2B:
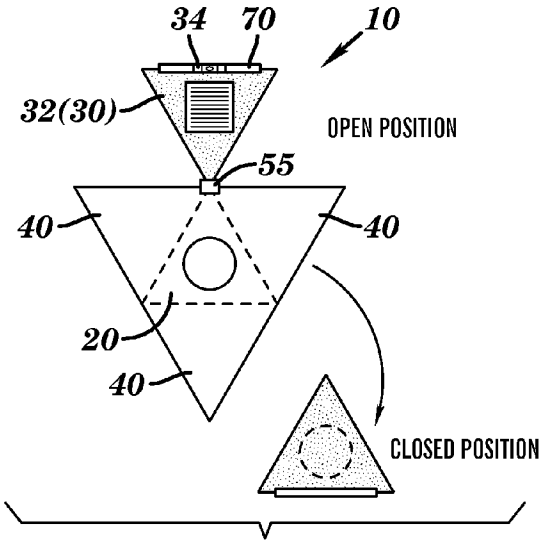
FIGS. 2A-2C show various embodiments of the self-aligning stencil device of the present invention. The stencil device is shown in its open position and closed position.

With regard to the central panel, the outer border and inner border of the central panel can be of the same or different shape, including, without limitation, the following shapes: a circle, an oval, an oblong shape, a triangle, a diamond shape, a star, a square, a rectangle, a pentagon, a hexagon, an octagon, an irregular shape, and the like. The shape of the inner border of the central panel will define the cut-out region that exposes the target surface for painting. Thus, the shape of the inner border can be selected with the multi-color composite image in mind, and need not be limited to a particular shape, but can include any desirable shape. As shown in FIGS. 2A, 2C, and 3A-3F, in view of the various shapes that the central panel can have, embodiments of the central panel can be such that the portion of the outer border of the central panel that forms the connection fold with the stencil panel can be either curved or straight. Further, as shown in FIG. 2B, in certain embodiments, the portion of the outer border of the central panel that forms the connection fold with the securing panel or a stencil panel can be pointed or substantially pointed (as a point of a triangle). In these embodiments, an adapter may be used to form the connection fold.

Figure 5:
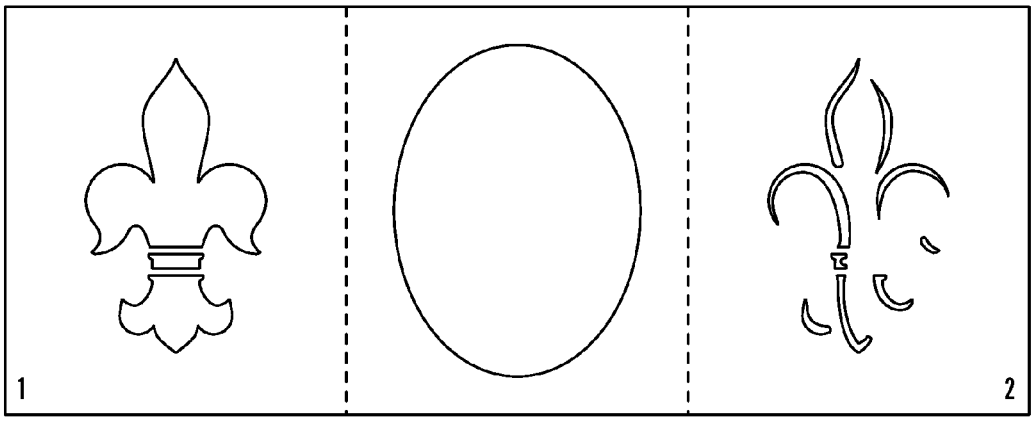
FIG. 5 is a schematic illustration of one embodiment of the self-aligning stencil device of the present invention. The embodiment shown in FIG. 5 is a three-plate stencil (also referred to herein as a three-panel stencil). The central panel is shown as having an oval-shaped cut-out region, although the present invention also contemplates the use of other shapes for the cut-out region (as discussed herein).
Figure 6:
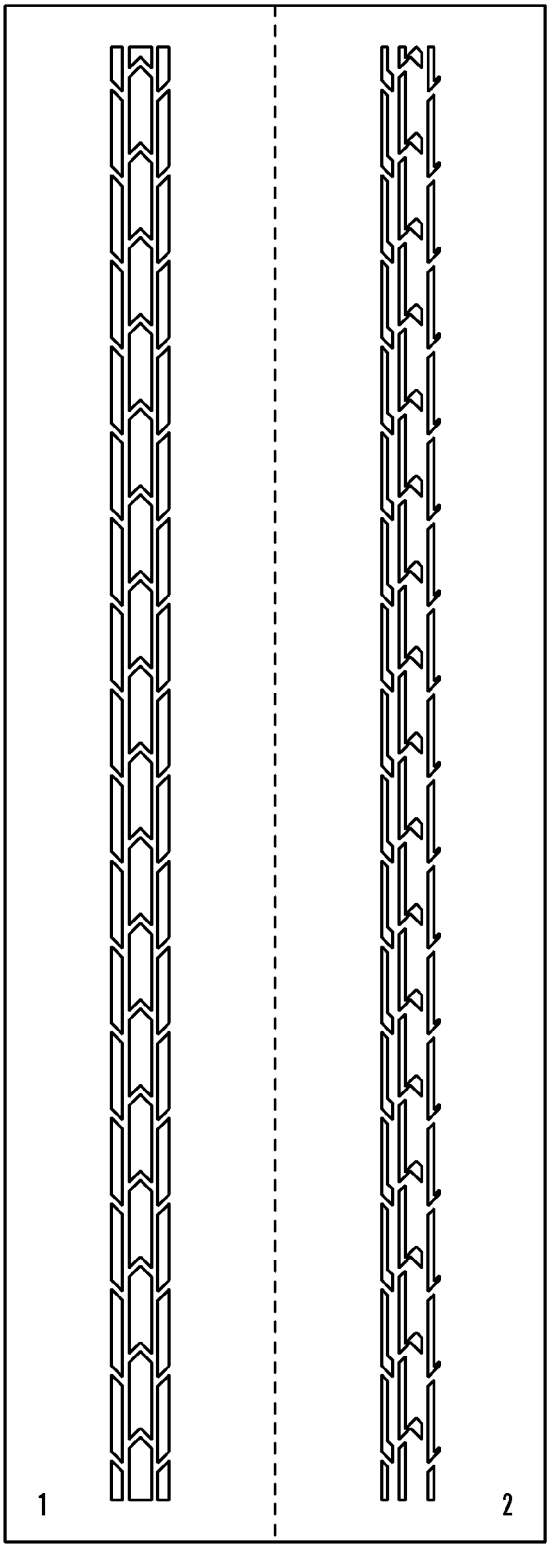
FIG. 6 is a schematic illustration of one embodiment of the self-aligning stencil device of the present invention. The embodiment shown in FIG. 6 is a two-plate stencil (also referred to herein as a two-panel stencil). In this type of embodiment, each of the two plates (or panels) has its own stencil pattern. Thus, one of the stencil panels functions as the central panel in that it can be removably attached to the surface onto which the stencil image is to be applied. For example, as shown in FIG. 6, in one embodiment of the two-plate stencil, plate 1 (left plate) could be removably secured to a surface, and then the stencil pattern of plate 1 applied to the surface. Thereafter, plate 2 (right plate) could be folded over plate 1, and a different color applied to the surface using the stencil pattern of plate 2.
Figure 7:
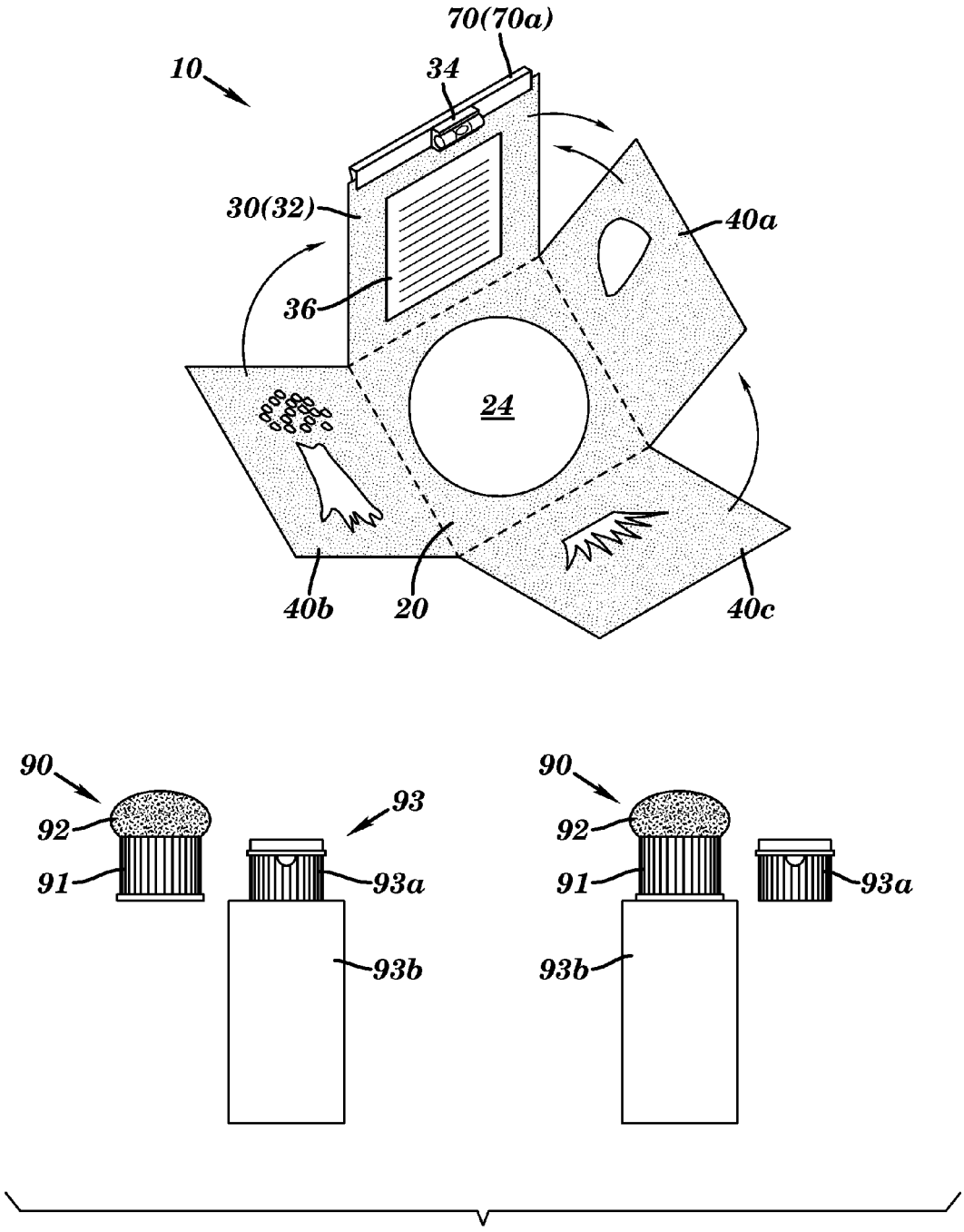
FIG. 7 shows one embodiment of the self-aligning stencil device of the present invention. Also shown in FIG. 7 is a leveling component 70 (e.g., a clip-on stencil level 70*a*) attached to securing panel 32. Also shown various accessories that can be included in a kit along with the stencil device, including, for example, paint bottle 93 and foam applicator cap 90.

With regard to the plurality of stencil panels, each stencil panel can be of the same or different shape as one another and of the same or different shape as the outer border of the central panel. Suitable shapes for the stencil panels include, without limitation, the following: a circle, an oval, an oblong shape, a triangle, a diamond shape, a star, a square, a rectangle, a pentagon, a hexagon, an octagon, an irregular shape, and the like. Further, the self-aligning stencil device of the present invention can include 2, 3, 4, 5, 6, or 8 different stencil panels, or certain of the stencil panels can be subdivided into multiple panels that fold onto the central panel on the same foldable connection but independently from one another. Illustrative examples of self-aligning stencil devices with the various numbers of stencil panels are shown in FIGS. 2A-2C, 3A-3F, 4A-4E, 5, and 6. In some of the stencil devices shown in these figures, the stencil devices are depicted as having a central panel with a circle shaped cut-out region, but not including a securing panel. However, the present invention is not limited to the embodiments depicted in the drawings. For example, in certain embodiments, the top stencil panel (if any) may be replaced by a securing panel (as described herein). Further, for illustrative purposes only, as depicted in FIGS. 4A-4E, the central panel, stencil panels, and securing panel (if any) are of the same shape, and in certain instances the shape corresponds to the number of stencil panels depicted (e.g., triangle shape for 3 stencil panels, square shape for 4 stencil panels, pentagon shape for 5 stencil panels, hexagon shape for 6 stencil panels, and octagon shape for 8 stencil panels). FIG. 5 illustrates a stencil device having two stencil panels, with the right stencil panel providing accents. FIG. 6 illustrates a unique stencil device where the central panel (left panel) also functions as a stencil panel. As noted, the present invention is not limited to the embodiments depicted in the figures.

Figure 2C:
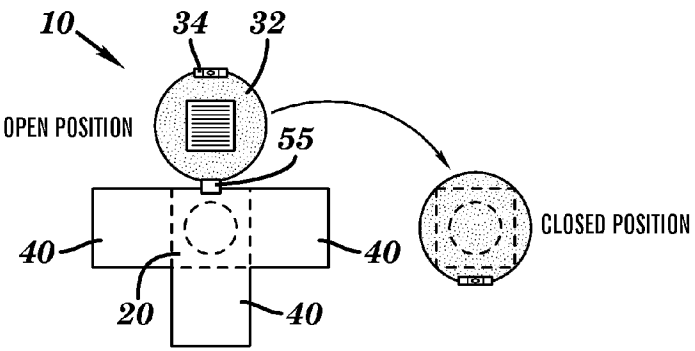
Figure 2A:
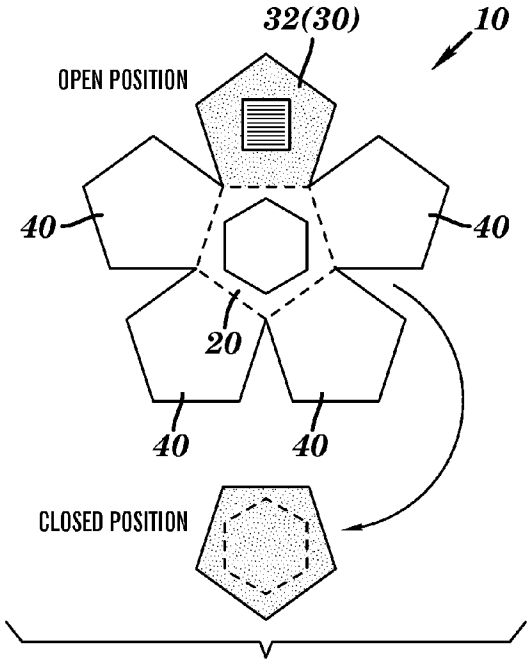
Figure 3A:
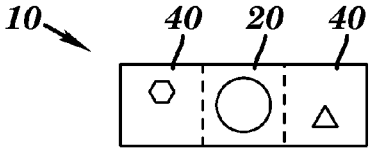
FIGS. 3A-3F show various embodiments of the self-aligning stencil device of the present invention. The stencil devices shown in these figures illustrate different attributes and aspects of the stencil device.
Figure 3B:
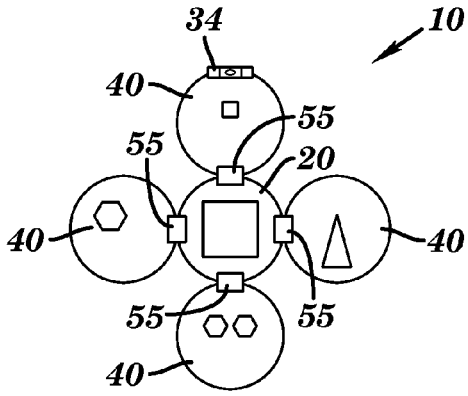
Figure 3C:
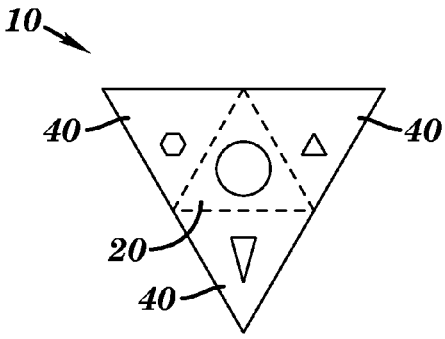
Figure 3D:
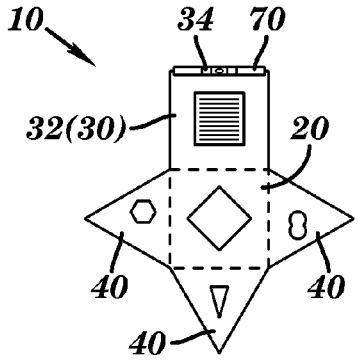
Figure 3E:
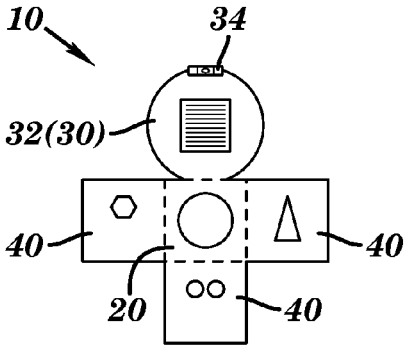
Figure 3F:
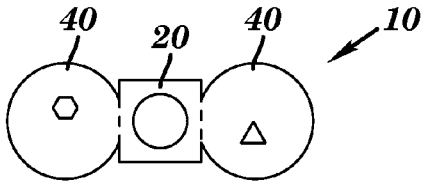
Figure 4A:
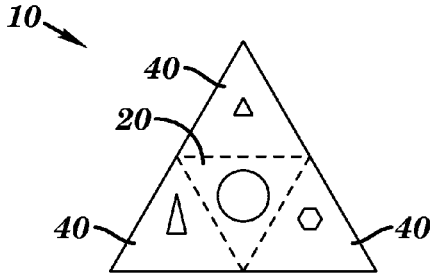
FIGS. 4A-4E show various embodiments of the self-aligning stencil device of the present invention. The stencil devices shown in these figures have central panels and stencil panels that are of the same shape and dimension.
Figure 4B:
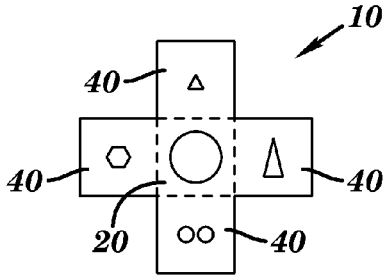
Figure 4C:
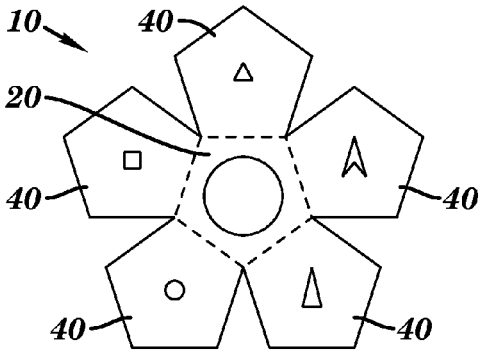
Figure 4D:
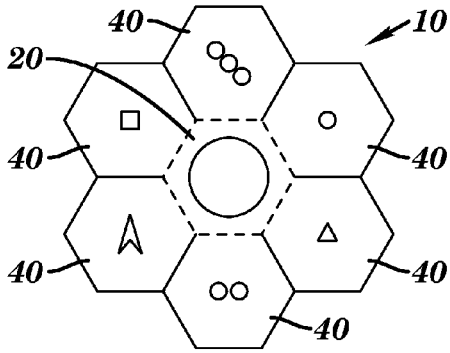
Figure 4E:
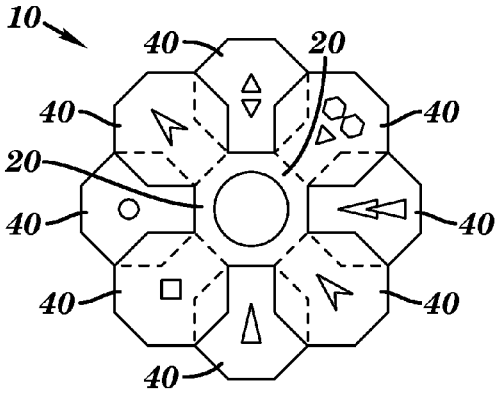

In one embodiment, the stencil panels can be foldably connected to the central panel with or without an adapter. FIG. 3B illustrates one embodiment of self-aligning stencil device 10 having central panel 20 foldably connected to stencil panels 40 by adapters 55. In addition, as shown in FIGS. 2B and 2C, adapter 55 can also be used to foldably connect securing panel 32 to central panel 20. Suitable adapters can include any device that is effective to secure the central panel to a stencil panel or a securing panel in a manner that allows the stencil panel or securing panel to fold onto the central panel and to be folded away from the central panel. For example, a suitable adapter can be configured to function as a hinge mechanism between the central panel and the stencil panel and/or securing panel. The adapter may also be configured to function as a spacer between the central panel and adjoining stencil panel or securing panel. Such a configuration may be desired, for example, when the number of stencil panels or the thickness of each stencil panel makes the overall thickness of the stencil device, when in the folded position, relatively larger than with fewer stencils. Such a configuration may also be desired if additional items (e.g., instructional booklet or DVD) are packaged within the folded stencil.

The self-aligning stencil device of the present invention can further include an attachment component for removably securing the central panel in a desired position on a surface. The attachment component can be indirectly or directly attached to the central panel. The attachment component can be of various configurations, as long as it functions to at least temporarily keep the central panel in place on the surface to be painted. For example, in one embodiment, the attachment component can be an adhesive material or an abrasive material topically disposed on at least a portion of the back surface of the central panel, with the adhesive material or abrasive material being configured to temporarily secure the central panel in place on the target surface. In various embodiments, the adhesive material or abrasive material is configured to be effective to temporarily secure the central panel on a vertical surface, on a horizontal surface facing upward, on a horizontal surface facing downward, or any other surface at any other planar angle. Various adhesives and abrasive materials suitable for use as an attachment component are known in the art and available commercially at arts and crafts and office supply stores.

In a particular embodiment, the attachment component can be provided in the form of a securing panel foldably connected to the upper most portion of the outer border of the central panel. The securing panel can be made of the same or different materials as the central panel and stencil panels. As shown in FIG. 1B, in one embodiment, securing panel 32 includes outer surface 32*a* and an opposing inner surface 32*b*, whereby inner surface 32*b* is such that it folds toward central panel 20. The securing panel can be of the same or different shape as the plurality of stencil panels or the central panel, with the shape of the securing panel being a circle, an oval, an oblong shape, a triangle, a diamond shape, a star, a square, a rectangle, a pentagon, a hexagon, an octagon, an irregular shape, and the like. The shape of the securing panel is not limited in that it can take the shape of any desired form, particular forms that relate to the multi-color composite image formed by the stencil. For example, if the stencil device forms a rain forest and frog image, the securing panel can be in the form of a tree or frog, as long as it still functions as described herein.

As described herein, the securing panel functions as an attachment component. Thus, the securing panel can be configured in numerous ways to achieve this function. For example, portions of the outer surface of the securing panel can include an adhesive material that is sufficient to hold the central panel in place. In this configuration, the adhesive is strong enough to counteract the gravitational pull on the stencil device (e.g., when removably secured to a vertical wall). The present invention also contemplates the use of piercing devices such as nails, thumb tacks, etc., that can pierce the securing panel (or even the central panel) to secure the securing panel to the surface (e.g., a vertical wall) during stenciling. Further, the securing panel can include a hole through which a piercing device may pass (e.g., as in a hole used in a wall hung calendar). The present invention also contemplates the use of attachment components (e.g., adhesives) to both the central panel and the securing panel.

As shown in FIGS. 1A, 1B, 2B, 2C, 3B, 3D, 3E, and 7, in various embodiments, securing panel 32 (also attachment component 30) can further include locking component 34. A suitable locking component 34 is any device that is configured to lock the plurality of stencil panels 40 and securing panel 32 (also attachment component 30) in place when all such panels are folded upon central panel 20. Suitable locking component devices are well known in the art and are available at arts and craft and office supply stores. As described elsewhere herein, a leveling component 70 can also serve as a leveling device as well as the locking component (see, e.g., FIGS. 2B, 3D, and 7).

As shown in FIGS. 1A, 1B, 2A, 2B, 2C, 3D, 3E, and 7, in various embodiments, securing panel 32 (also attachment component 30) can further include instructions 36 for using self-aligning stencil device 10. As shown in the aforementioned figures, instructions 36 can be disposed on at least a portion of the inner surface of the securing panel, so that such instructions are visible when the securing panel is not folded upon the central panel. Instructions can be in the form of text, graphics, color-coding, and the like. The securing panel can be made of a waterproof material so that the instructions, when exposed to moisture, maintain their visibility. Likewise, the central panel and stencil panels may also be made of the same material (including waterproof material) as the securing panel. Further, the instructions need not be limited to the inner surface of the securing panel. For example, as described elsewhere herein, instructional information can also be disposed on the central panel and stencil panels (see, e.g., FIGS. 11A-11C). In addition, instructional information can be included in separate booklets, pamphlets, and/or DVDs packaged along with the stencil device.

The central panel can further include placement components for securing each stencil panel in place when the stencil panel is folded upon the central panel. Suitable placement components can include, without limitation, low-tack adhesive tabs. FIG. 15E illustrates an embodiment of the self-aligning stencil device of the present invention where the stencil panels include placement components (e.g., low-tack adhesive tabs).

The stencil device of the present invention can be made of various types of materials suitable for use with stencils. Suitable materials can include various types of plastics or synthetic polymers known in the stenciling art. As describe herein, all of the panels (i.e., the central panel, stencil panels, and securing panel) can be made of this material, or made of different materials (including paper, cardboard, metallic materials, and the like).

In one embodiment, the central panel, the plurality of stencil panels, and the securing panel can be made of a paint repelling material that is effective to repel the adhesion of paint. In a particular embodiment, the paint repelling material can be polypropylene and the like.

The self-aligning stencil device of the present invention can further include at least one leveling component securely or removably attached to either the central panel or the securing panel. The present invention also contemplates configurations in which the leveling component can be used with any one of the stencil panels. The leveling component can be configured to identify a level position of the central panel relative to a horizontal plane. Further, the leveling component can be configured to identify any level position desirable to the user, whether or not that desired position is a level position of the central panel relative to a horizontal plane. Suitable leveling components can include, without limitation, a bubble-in-liquid level, a clinometer, an LCD level, and the like. Further, in a particular embodiment, the leveling component can be a stencil leveling device particularly suited for use with stencils, including clip-on stencil level devices (see, e.g., FIGS. 8A-8C).

Figure 8A:
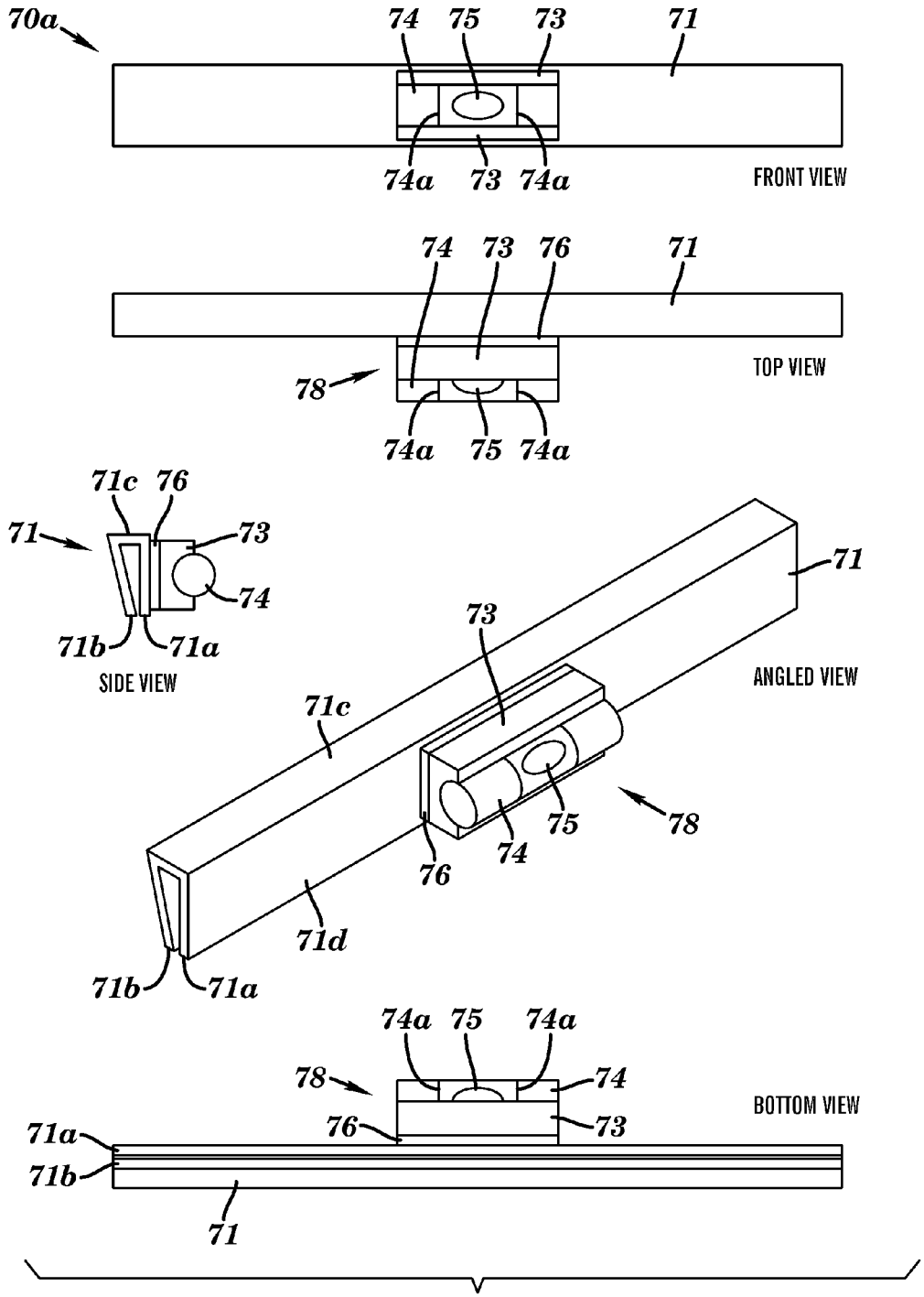
FIGS. 8A-8C show one embodiment of a leveling component that can be used along with the self-aligning stencil device of the present invention.
Figure 8B:
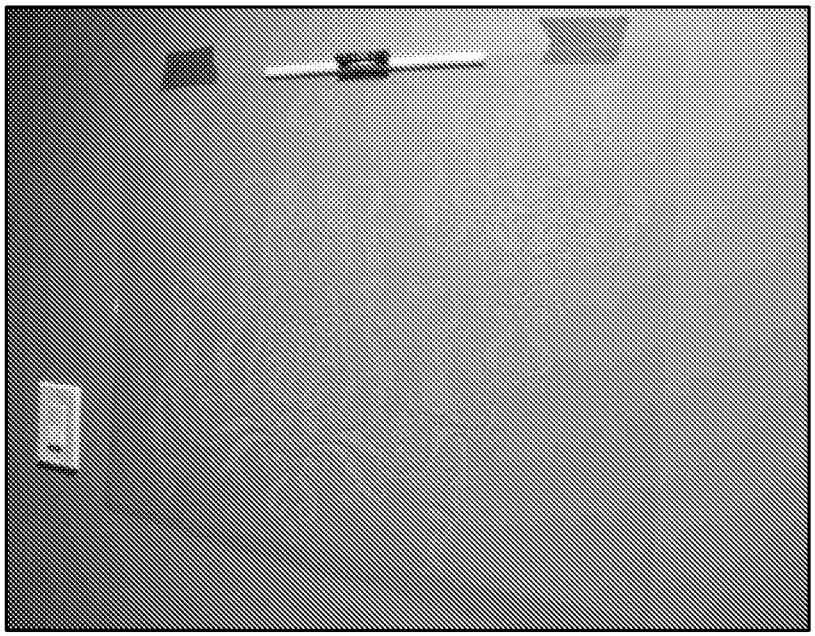
Figure 8C:
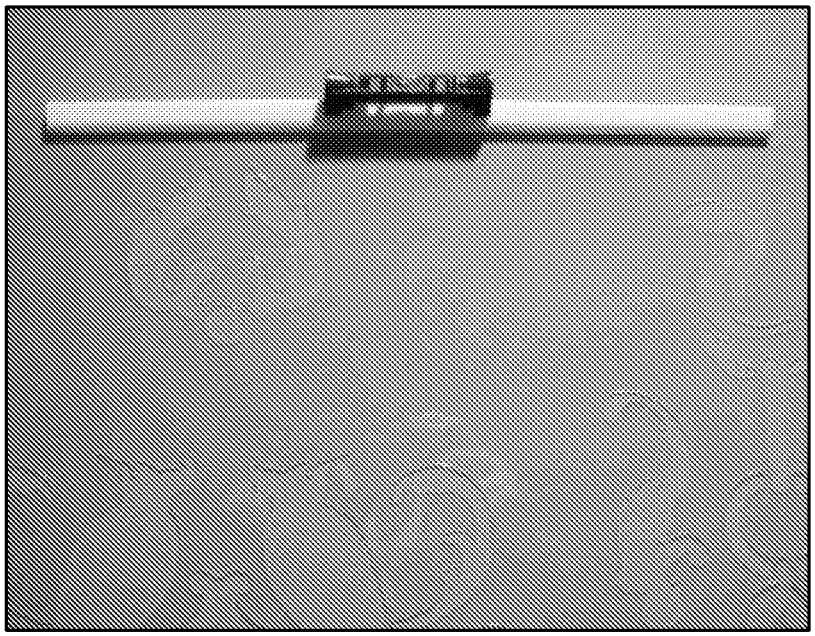

As shown in FIGS. 7 and 8A-8C, in one embodiment, leveling component 70 can be configured as a clip-on stencil level. As shown in FIGS. 7 and 8A-8C, this sort of leveling component 70 can clip to the top edge of securing panel 32, and can also serve as locking component 34 when storing stencil device 10 in its closed position. As shown in FIG. 8A, clip-on stencil level 70*a* includes support bar 71 (e.g., C-Line Slide Binding Bar, Product No. CLI34551) having clip ends 71*a* and 71*b*, top support 71*c*, and front face 71*d*. Clip-on stencil level 70*a* also includes leveling unit 78 (e.g., Empire Level, Model No. 82PLP-W) attached to front face 71*d* of support bar 71. Leveling unit 78 includes holder 73 that acts as a support for bubble level component 74 that includes level indicator markings 74*a*, whereby a level position is indicated when bubble 75 is positioned between level indicator markings 74*a*. Holder 73 may be attached to front face 71*d* by attaching means 76 (e.g., Scotch foam mounting tape by 3 M). Various types of support bar 71, leveling unit 78, and attaching means 76 are well known in the art, so that clip-on stencil level 70*a* can be made with any of these other types of components that make up clip-on stencil level 70*a*.

In one embodiment, the leveling component can be attached to the central panel. Depending on the placement of the leveling component on the central panel, the stencil device can further include leveling component cut-out regions forming a vacant area on each stencil panel (e.g., a cut-out region contained within each of the plurality of stencil panels). These leveling component cut-out regions can be strategically placed to allow the leveling component to protrude therethrough when each stencil panel is folded onto the central panel (see FIG. 9, reference numbers 72*a*, 72*b*, 72*c*, and 72*d*).

Figure 10:
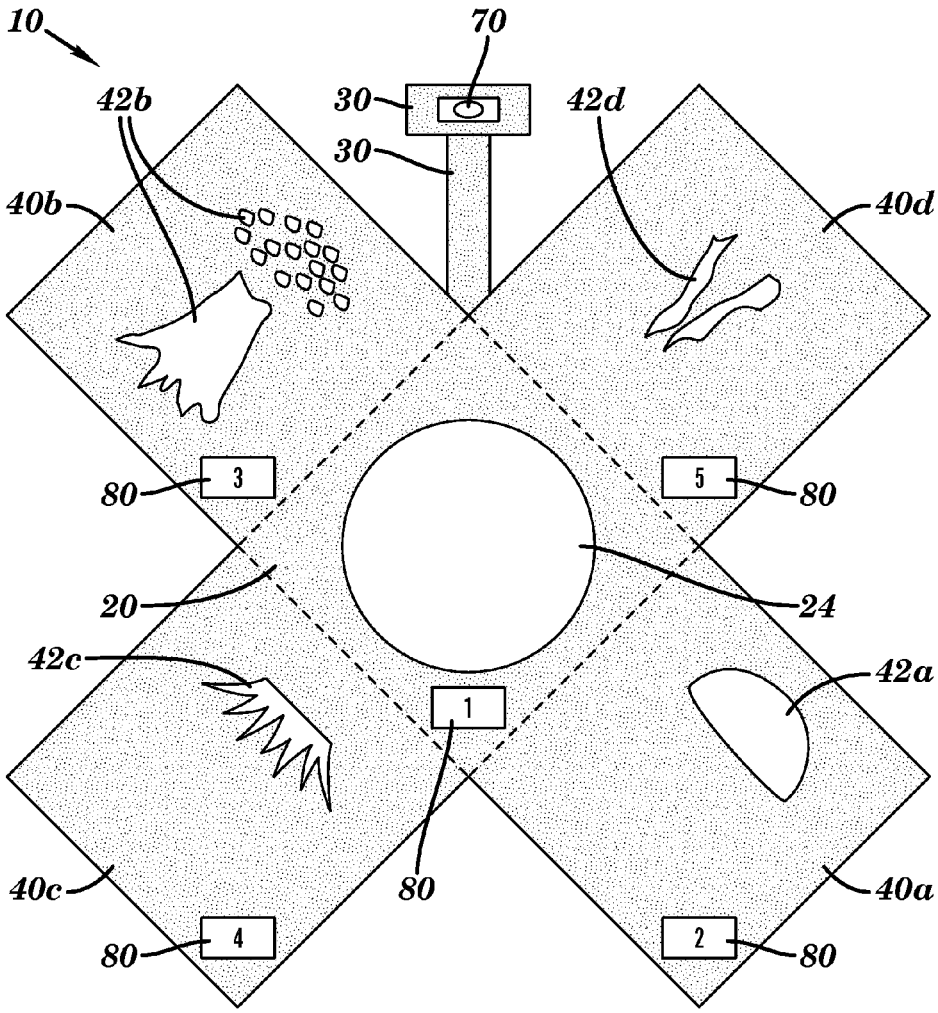
FIG. 10 is a schematic illustration of one embodiment of the self-aligning stencil device of the present invention. The embodiment shown in FIG. 10 includes four stencil panels, where the attachment component is configured to allow the stencil device to be temporarily secured in an off-set position. This embodiment also includes a leveling component attached to the attachment component. The embodiment shown in FIG. 10 also includes color-coded numerical instructions on each of the stencil panels and on the central panel, as denoted by the colored squares containing the numerals 1, 2, 3, 4, or 5.

In another embodiment, the leveling component can be attached to the attachment component (see FIG. 10, reference number 70).

The self-aligning stencil device of the present invention can further include color-coded instructions on the various panels, e.g., on each of the plurality of stencil panels as shown in FIGS. 10 and 11A-11C. In this embodiment, the instructions are effective to instruct a user on the order and color to use for each stencil panel. Suitable color-coded numerical instructions can include, without limitation, color-coded numerals in sequential order, signifying the color and order for each stencil panel.

Figure 9:
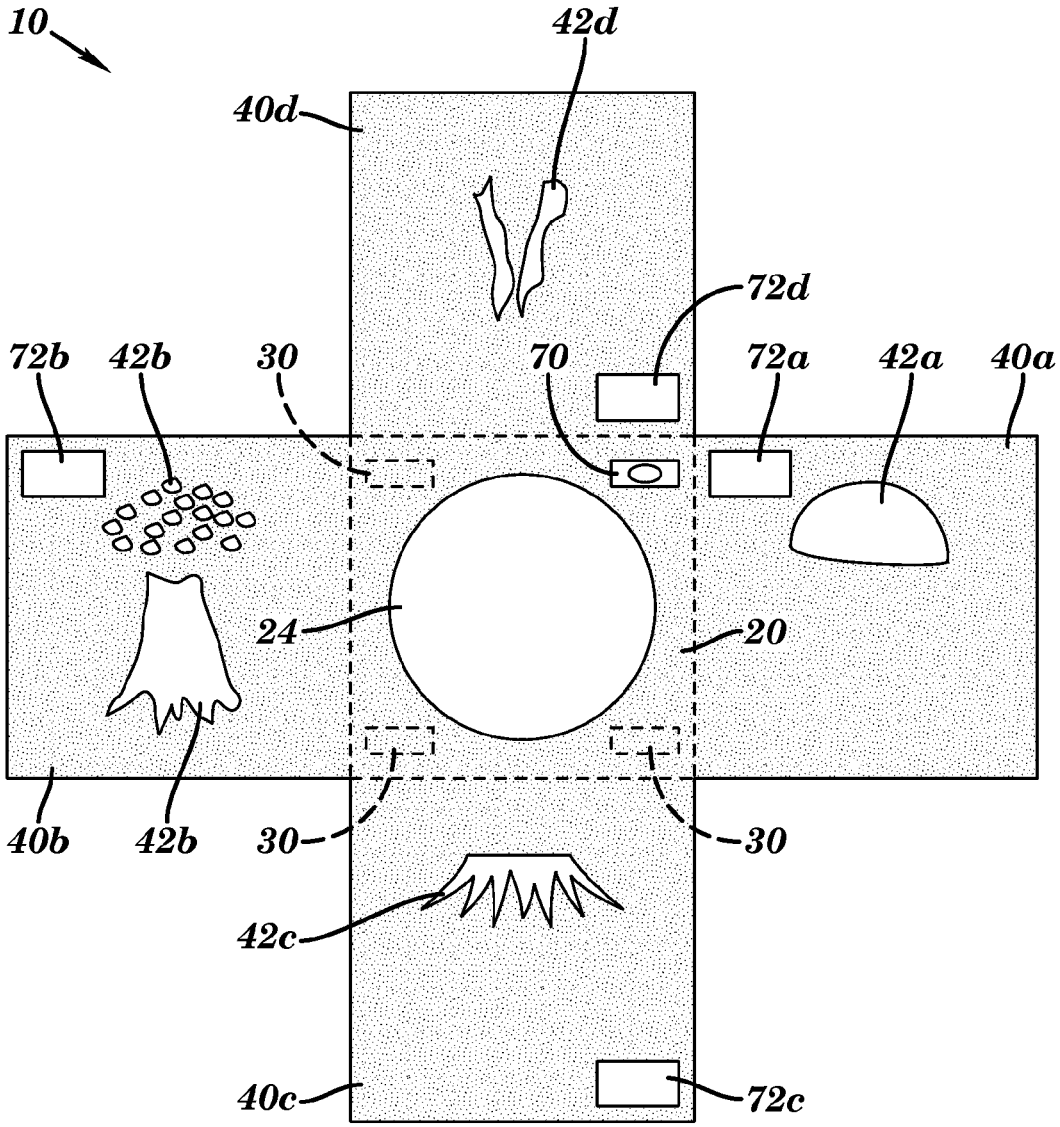
FIG. 9 is a schematic illustration of one embodiment of the self-aligning stencil device of the present invention. The embodiment shown in FIG. 9 includes four stencil panels, where the attachment component is directly attached to the back surface of the central panel. This embodiment also includes a leveling component attached to the central panel.

Turning to FIG. 9, in one embodiment, self-aligning stencil device 10 is shown as having a four-sided central panel 20 (e.g., square or rectangular), attachment components 30 situated on the back portion of central panel 20, and four stencil panels (40*a*, 40*b*, 40*c*, and 40*d*). Each stencil panel has its own distinct stencil pattern (42*a*, 42*b*, 42*c*, or 42*d*). This embodiment of stencil device 10 also includes leveling component 70 attached to the front surface of central panel 20. To accommodate leveling component 70, each stencil panel 40 (depicted as 40*a*, 40*b*, 40*c*, and 40*d*) also includes a leveling component cut-out region 72 (depicted as 72*a*, 72*b*, 72*c*, and 72*d*), which allow leveling component 70 to fit therein when each stencil panel 40 (depicted as 40*a*, 40*b*, 40*c*, and 40*d*) is folded onto central panel 20.

Turning to FIG. 10, in one embodiment, self-aligning stencil device 10 is shown as being configured so that it can be secured in an off-set fashion. This embodiment allows for an image to be stenciled onto a surface in a slanted manner. The same stencil device 10 can be positioned so that it can also be used to apply the same image in an upright position. As shown in FIG. 10, attachment component 30 can be a separate component from central panel 20. Here, attachment component 30 further includes leveling component 70, which can be effectively used to position stencil device 10 in a uniform manner for repeated, uniform image application on a surface. The embodiment of stencil device 10 as shown in FIG. 10 includes a four-sided central panel 20, attachment component 30, and four stencil panels 40 (depicted as 40*a*, 40*b*, 40*c*, and 40*d*). Each stencil panel has its own unique stencil pattern 42 (42*a*, 42*b*, 42*c*, or 42*d*). Further, color-coded instructions 80 are provided on the central panel 20 and each stencil panel (40*a*, 40*b*, 40*c*, and 40*d*), instructing the user on the preferred order and paint color when applying paint to the stencil to produce the multi-color composite image.

As shown in FIG. 10, color-coded instructions 80 are effective to allow the user to properly apply stencil patterns 42*a*, 42*b*, 42*c*, and 42*d* in the appropriate order using the suggested color. For example, first, the user would paint the color yellow in central panel cut-out region 24. Second, the user would then fold stencil panel 40*a* onto central panel 20 and paint the color red in stencil pattern 42*a*, and then unfold stencil panel 40*a* from central panel 20. Third, the user would fold stencil panel 40*b* onto central panel 20 and paint the color white in stencil pattern 42*b*, and then unfold stencil panel 40*b* from central panel 20. Fourth, the user would fold stencil panel 40*c* onto central panel 20 and paint the color green in stencil pattern 42*c*, and then unfold stencil panel 40*c* from central panel 20. Fifth, the user would fold stencil panel 40*d* onto central panel 20 and paint the color blue in stencil pattern 42*d*, and then unfold stencil panel 40*d* from central panel 20. Upon completion of the above-described steps, a multi-color image made of five colors (i.e., yellow, red, white, green, and blue) would be produced on the surface in central panel cut-out region 24. Stencil device 10 could then be removed from the surface and re-used on a different region of the surface, if desired.

As noted above, in another aspect, the present invention also relates to a kit for producing a multi-color composite image or images to a target surface. The kit includes a self-aligning stencil device of the present invention and at least one painting supply for use in applying paint to a surface. As used herein, the term "painting supply" is meant to broadly refer to any device, material, or instructional information that assists the user in using the self-aligning stencil device to create a multi-color composite image on a target surface. Thus, the term "painting supply" shall not be limited to just paints, paint brushes, or paint rollers. In various embodiments, other components may be added to the kit of the present invention.

For use in the kit of the present invention, suitable painting supplies can include, without limitation, a plurality of paints of different colors. For example, the kit can include the different colors of paint corresponding to each of the stencil panels of the stencil device. In a particular embodiment, the color of paints included in the kit can be a preferred color that would produce an artistically appealing and/or accurate rendition of the multi-color composite image of the particular stencil device included in the kit. It is recognized, however, that the user may use other paints not provided with the kit when using the stencil device contained in the kit.

In a particular embodiment, the painting supplies contained in the kit can include, without limitation, at least one paintbrush (or other paint applicator such as a paint roller) and a plurality of paints of different colors.

The kit of the present invention can further include at least one foam applicator cap suitable for attaching to a paint bottle and for applying paint to a surface. As shown in FIGS. 7, 11A, 12A-12C, 13, and 14, in one embodiment, foam applicator cap 90 includes dense foam component 92 and cap component 91. Cap component 91 is configured with threading 95 that is suitable for twisting onto threading 94 of a standard paint bottle 93. Cap component 91 is further configured to include at least one dispensing hole 91*a* at its top most portion, i.e., the portion that is in contact with dense foam component 92. To use foam applicator cap 90, paint bottle cap 93*a* is twisted off to remove it from paint bottle chamber 93*b*. Foam applicator cap 90 is then twisted onto compatible threading 94 of paint bottle chamber 93*b*. Paint can then be dispensed through foam applicator cap 90 by positioning paint bottle 93 in a manner to allow gravity to pull the paint in a direction toward the target surface to be painted. The user can press, swipe, dab, and/or brush foam applicator cap 90 onto the target surface, thereby applying paint to the target surface. Foam applicator cap 90 is particularly useful for applying various shades of color.

In one embodiment, dense foam component 92 can be made of any dense foam material, e.g., any dense foam used in a foam roller. The dense foam material can then be stretched over a bottle cap (e.g., a 2 ounce paint bottle cap with its lid removed). A suitable plastic tube can then be slipped over the dense foam and secured to the bottle cap (i.e., cap component 91) with an adhesive (e.g., a glue made with cyanoacrylate such as Super Glue). The foam applicator may also be injection molded.

The kit of the present invention can further include at least one additional self-aligning stencil device that is effective to produce a final image different from the original stenciling device. For example, the different stencil devices can be used to create images that belong in a scene, or images that belong to a particular theme. The additional stencil device can be another self-aligning stencil device of the present invention, but it need not be.

The kit of the present invention can further include a plurality of cards that are suitable for applying paint thereto. For example, the cards can be blank cards that the user can use with the stencil device to paint a multi-color composite image thereon. In this kit, other supplies such as paints, brushes, rollers, foam applicator caps, etc., may be provided.

The kit of the present invention can further include a container suitable for holding the contents of the kit.

The kit of the present invention can further include a stencil cleaning solution. Various cleaning solutions known in the relevant field are contemplated by the present invention.

The kit of the present invention can further include an abrasive stencil cleaning tip for attaching to a stencil cleaning solution bottle, where the abrasive stencil cleaning tip is effective for facilitating application of a stencil cleaning solution and removal of paint from a stencil panel. In a particular embodiment, foam applicator cap 90 can be used as an abrasive stencil cleaning tip.

The kit of the present invention may also include at least one leveling component that is configured to be used with the self-aligning stencil device of the present invention. Suitable leveling components can include any of those described herein (see, e.g., FIGS. 7, 8A-8C, 9, and 10).

As noted above, in a further aspect, the present invention relates to a method of producing a multi-color image to a surface.

In one embodiment, the method involves providing a self-aligning stencil device according to the present invention (this step being referred to herein as "Step (1)"). The central panel is then temporarily secured, either directly or indirectly, to a surface to which the multi-color composite image is to be produced thereon, so that each of the stencil panels is in an unfolded position (this step being referred to herein as "Step (2)"). Paint is then applied to the surface using a first stencil panel as follows: (i) folding a first stencil panel onto the central panel; (ii) applying a first paint color to the surface as defined by the first stencil panel; and (iii) unfolding the first stencil from the central panel (this step being referred to herein as "Step (3)"). Step (3) is then repeated for each of the remaining stencil panels until the desired final multi-color image is produced on the surface (this step being referred to herein as "Step (4)").

In one embodiment, the method can further include applying a background paint to the surface as defined by the cut-out region of the central panel. This step can be performed prior to performing Step (3).

In one embodiment, the method can further include repeating Steps (3) and (4) for at least one of the stencil panels in order to produce a shading and/or highlighting effect on the final image. The repeating may be done using the same or a different color of paint as originally used for the subject stencil panel.

In one embodiment, Step (3)(i) of the method can involve temporarily securing the stencil panel in place for the paint application Step (3)(ii).

The method of the present invention is effective to apply a multi-color composite image (including a multi-layer image) to various surfaces, including, for example, a vertical surface, a horizontal surface facing upward, a horizontal surface facing downward, and any other surface at any other planar angle.

In one embodiment, the attachment component used in the method can be a securing panel (as described herein), where the securing panel includes a plane having the same number of edges and substantially the same shape as the central panel, and where the securing panel is foldably connected to a corresponding edge of the central panel.

The method of the present invention can further include the step of providing instructions for using the stencil device. In one embodiment, the instructions can be disposed on at least a portion of the inner surface of the securing panel, so that such instructions are visible when the top securing panel is not folded upon the central panel.

The method of the present invention can further include the step of providing color-coded numerical instructions positioned on the plurality of stencil panels, thereby instructing a user of the order and color for each stencil panel.

The method of the present invention can further include the step of using a leveling component to assist in temporarily securing the central panel in place at a level position. Various leveling components and configurations are as described herein.

Figure 15A:
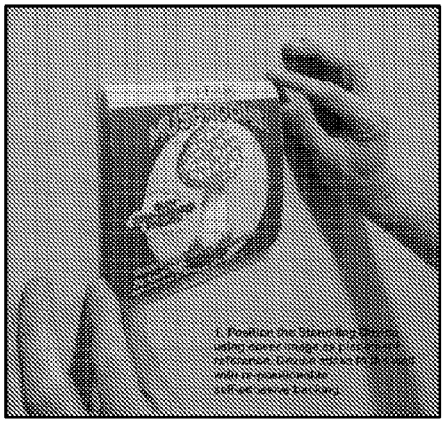
FIG. 15A is a color photograph of one embodiment of the stencil device of the present invention. This figure illustrates how the final image on the packaging of the stencil device can be used to position the stencil device on a surface. In one embodiment, the stencil device can include a re-positionable, self-adhesive backing.
Figure 15B:
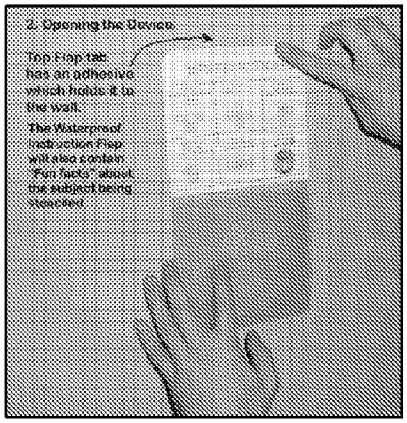
FIG. 15B is a color photograph of one embodiment of the stencil device of the present invention. This figure illustrates how the stencil device can be opened by unfolding the top securing panel, which reveals instructions (as shown in this embodiment). In this embodiment, the top securing panel includes a top flap tab that has an adhesive that can hold the stencil device to the surface (e.g., to a vertical wall). In addition, as shown in FIG. 15B, various embodiments of the top securing panel can also include additional text such as "fun facts" about the image to be stenciled.
Figure 15C:
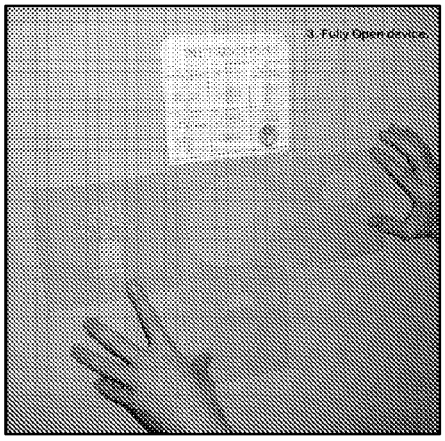
FIG. 15C is a color photograph of one embodiment of the stencil device of the present invention. This figure illustrates the stencil device temporarily secured to a vertical wall in a fully open position, i.e., with all of the panels unfolded from the central panel.
Figure 15D:
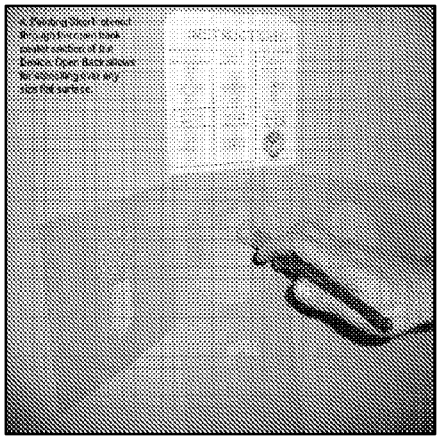
FIG. 15D is a color photograph of one embodiment of the stencil device of the present invention. This figure illustrates the stencil device in a fully open position with the user applying yellow paint to the surface, as guided by the cut-out region of the central panel.
Figure 15E:
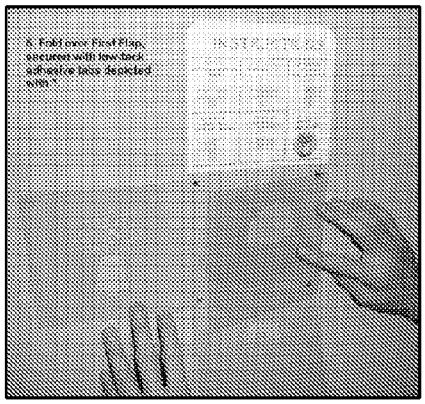
FIG. 15E is a color photograph of one embodiment of the stencil device of the present invention. This figure illustrates a first stencil panel (referred to in the figure as the "First Flap") being folded onto the central panel. In the illustrated embodiment, the central panel includes low-tack adhesive tabs (depicted with asterisks), which aid in securing the stencil panel to the central panel during the application of paint to the surface.
Figure 15F:
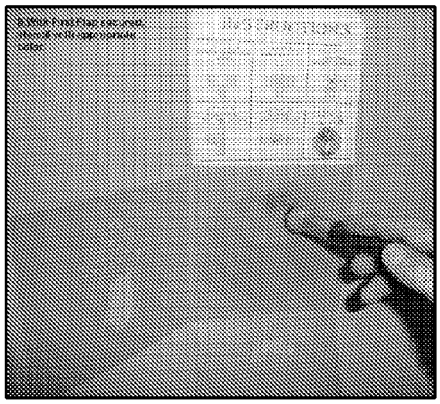
FIG. 15F is a color photograph of one embodiment of the stencil device of the present invention. This figure illustrates a first stencil panel ("First Flap") in a secured position with red paint being applied to the surface, as guided by the stencil panel.
Figure 15G:
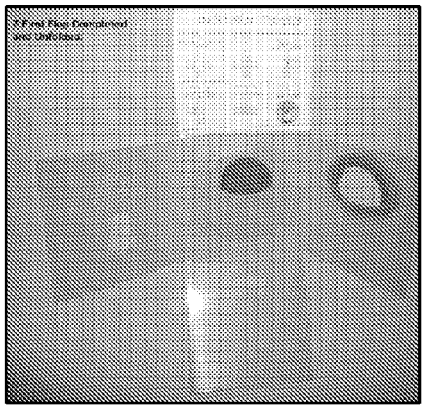
FIG. 15G is a color photograph of one embodiment of the stencil device of the present invention. This figure illustrates the stencil device in an unfolded position, after the application of the red paint, as guided by the first stencil panel. The resulting image shows the yellow background (previously applied) with a red mushroom top imposed on the yellow background.
Figure 15H:
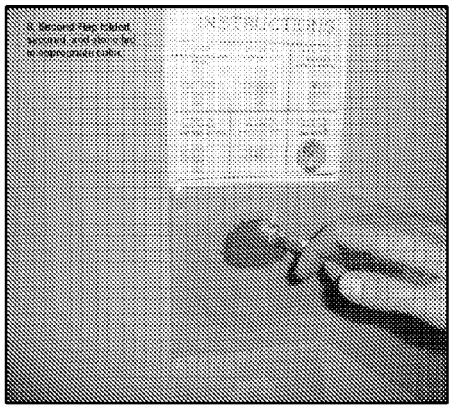
FIG. 15H is a color photograph of one embodiment of the stencil device of the present invention. This figure illustrates a second stencil panel ("Second Flap") in a secured position and folded onto the central panel. In this figure, white paint is being applied, as guided by the second stencil panel.
Figure 15I:
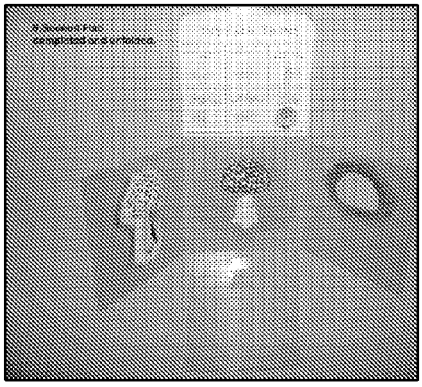
FIG. 15I is a color photograph of one embodiment of the stencil device of the present invention. This figure illustrates the stencil device in an unfolded position, after the application of the white paint, as guided by the second stencil panel. The resulting image shows the yellow background (previously applied) with a red mushroom top (previously applied) imposed on the yellow background, a white mushroom stalk, and white spots imposed on the red mushroom top.
Figure 15J:
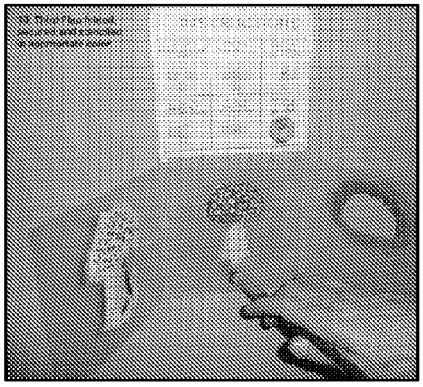
FIG. 15J is a color photograph of one embodiment of the stencil device of the present invention. This figure illustrates a third stencil panel ("Third Flap") in a secured position and folded onto the central panel. In this figure, green paint is being applied, as guided by the third stencil panel.
Figure 15K:
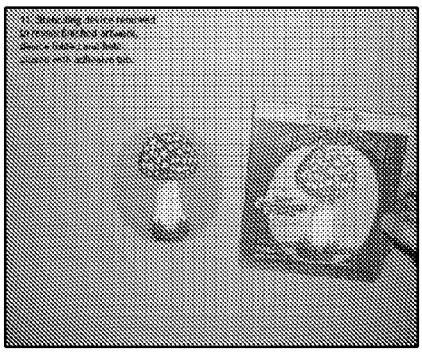
FIG. 15K is a color photograph of the completed multi-color image on a surface, as applied using one embodiment of the stencil device of the present invention. The image is a mushroom. The stencil device used to produce the image is shown in a completely folded/stored position, held closed with adhesive tabs. On the cover of the stencil device is a picture of the image and other text describing the stencil device and its features.
Figure 15L:
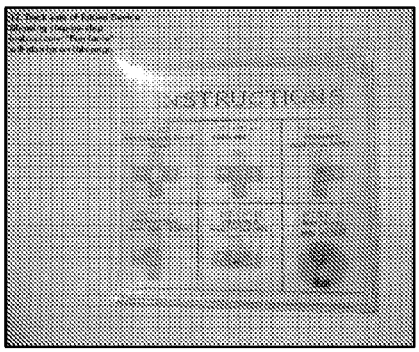
FIG. 15L is a color photograph of the back side of one embodiment of the stencil device of the present invention. This figure illustrates the stencil device in a completely folded/stored position, with the instructions and other text (e.g., fun facts) visible through the packaging.

FIGS. 15A-15L illustrate the steps of one embodiment of this method using one embodiment of the self-aligning stencil device of the present invention. The method steps shown in FIGS. 15A-15L are listed below: FIG. 15A: Positioning the Device: Position the stencil device using the cover image as a placement reference. The stencil device sticks to the wall with re-positionable self-adhesive backing. FIG. 15B: Opening the Device: The top flap tab has an adhesive that holds the stencil device to the wall. As in the embodiment shown, the waterproof instruction flap may also contain "fun facts" about the subject being stenciled. FIG. 15C: Depicts the fully opened stencil device prior to painting. FIG. 15D: Painting Step 1: Paint through the open back center section of the stencil device. The open back (i.e., cut-out region) allows for stenciling over any size flat surface. FIG. 15E: Fold over First Flap, which can be secured with low-tack adhesive tabs depicted with asterisk (*) in the figure. FIG. 15F: With the First Flap secured, stencil (meaning paint) with the appropriate color paint. FIG. 15G: The First Flap stenciling is completed and unfolded. FIG. 15H: The Second Flap is folded and secured, and stenciled with the appropriate color paint. FIG. 15I: The Second Flap stenciling is completed and unfolded. FIG. 15J: The Third Flap is folded and secured, and stenciled with the appropriate color paint. FIG. 15K: The stencil device is removed from the wall to reveal a finished artwork (multi-color composite image), the device is folded and held closed with an adhesive tab, in the embodiment shown in the figures. FIG. 15L: This shows the back side of the folded stencil device, showing step-by-step instructions. Optional "fun facts" or other text or images can also be included on this back side.

As set forth below, the self-aligning stencil device of the present invention has a number of characteristics not found in prior art stencil devices.

Self-Aligning, Multi-Overlay Flaps:

As shown in FIG. 15C, the stencil device of the present invention provides a device that includes self-aligning, multi-overlay flaps (also referred to herein as stencil panels). This configuration allows the user to paint a multi-layer, multi-color stencil pattern onto various surfaces without the alignment problems associated with traditional separate plate multi-layer stencils. Once the stencil device of the present invention is positioned, folding over each flap (i.e., stencil panel) ensures proper alignment. The present invention contemplates different configurations such as the vertical design, the fan design, the star design, and others.

Open-Backed Center Section:

As shown in FIG. 15D, the stencil device of the present invention allows the user to use the device on most any surface, including, for example, vertical surfaces such as walls. Therefore, the user is not limited to a sheet of paper that needs to fit within the device.

Paint Repellant Material:

In one embodiment, the stencil device of the present invention can be made of a paint repellant material. Suitable paint repellant materials can include, without limitation, polypropylene and the like. In a specific embodiment, the panels of the stencil device of the present invention can be made of 12-14 mm polypropylene (or the like), which repels the adhesion of paint, making it easier to clean than some other materials.

Self-Adhesive Backing:

As shown in FIG. 15A, the stencil device of the present invention allows the user to place the stencil device on a vertical surface, such as a wall, or upside down, such as a ceiling, and still have both hands free to fold the flaps and to stencil the design.

Self-Adhesive Flaps:

As shown in FIG. 15E, the stencil device of the present invention can be provided to include an adhesive on each of the flaps (i.e., the panels) to secure them in place when they have been folded over prior to stenciling that plate. This could also be achieved with built in tabs, snaps, Velcro, or the like.

Cover Image Doubles as Placement Template:

As shown in FIG. 15A, when the stencil device of the present invention is in the fully closed position, the cover image depicting the artwork to be stenciled can serve to represent the exact location of the stencil when unfolded. The user would simply position the stencil device in the closed position using the cover image as a reference, then unfold and follow the built-in instructions to create the artwork in the exact location of the cover image. This allows the user to see what the finished artwork will look like in its exact location.

Built-In Waterproof Instructions:

As shown in FIG. 15B, when the stencil device of the present invention is placed on the surface and opened, the top flap (also referred to herein as the "securing panel") can be configured to reveal step by step instructions printed on a waterproof sticker or the like. This configuration keeps the instructions with the stencil device at all times, and the waterproof feature allows for easy cleaning of the device without damaging the built-in instructions.

Figure 11A:
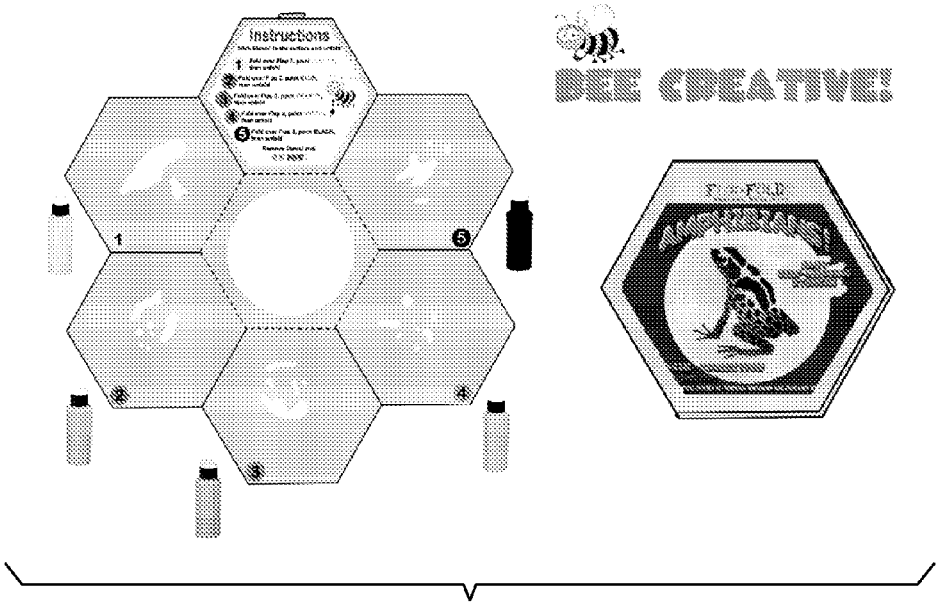
FIG. 11A is a schematic illustration of one embodiment of the self-aligning stencil device of the present invention. In the embodiment shown in FIG. 11A, the stencil device includes a central panel having six edges and a circular cut-out region, although the present invention is not limited to a central panel with six edges or a circular cut-out region. The stencil device also includes a top securing panel and five stencil panels, all of which are in the shape of a hexagon. The five stencil panels each contain a partial image of the final desired image.
Figure 11B:
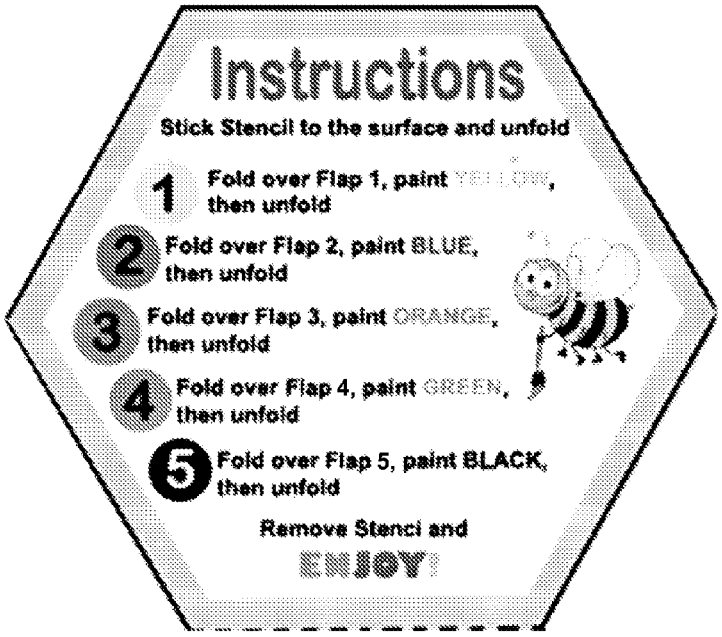
FIG. 11B is a schematic illustration of one embodiment of the step by step instructions that can be contained on the top securing panel. The instructions of FIG. 11B are for the stencil device illustrated in FIG. 11A.
Figure 11C:
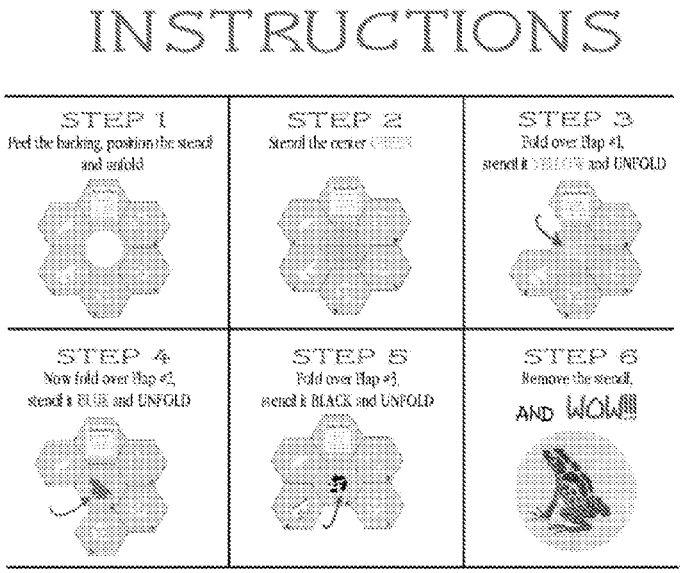
FIG. 11C is a schematic illustration of one embodiment of the step by step instructions that can be contained on the top securing panel. The instructions of FIG. 11C are for the stencil device illustrated in FIG. 11A.
Figure 12A:
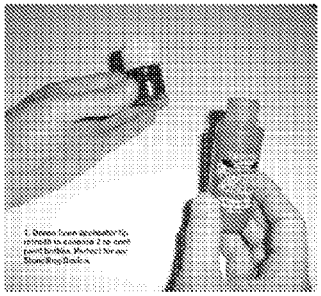
FIGS. 12A-12C are color photographs of a dense foam applicator tip retro-fit to standard two ounce craft paint bottles.
Figure 12B:
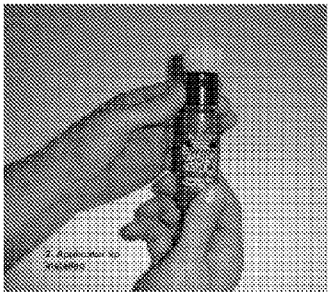
Figure 12C:
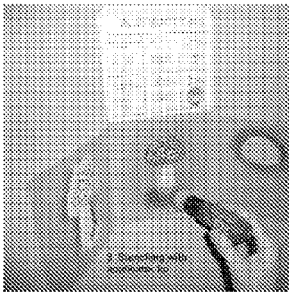
Figure 13:
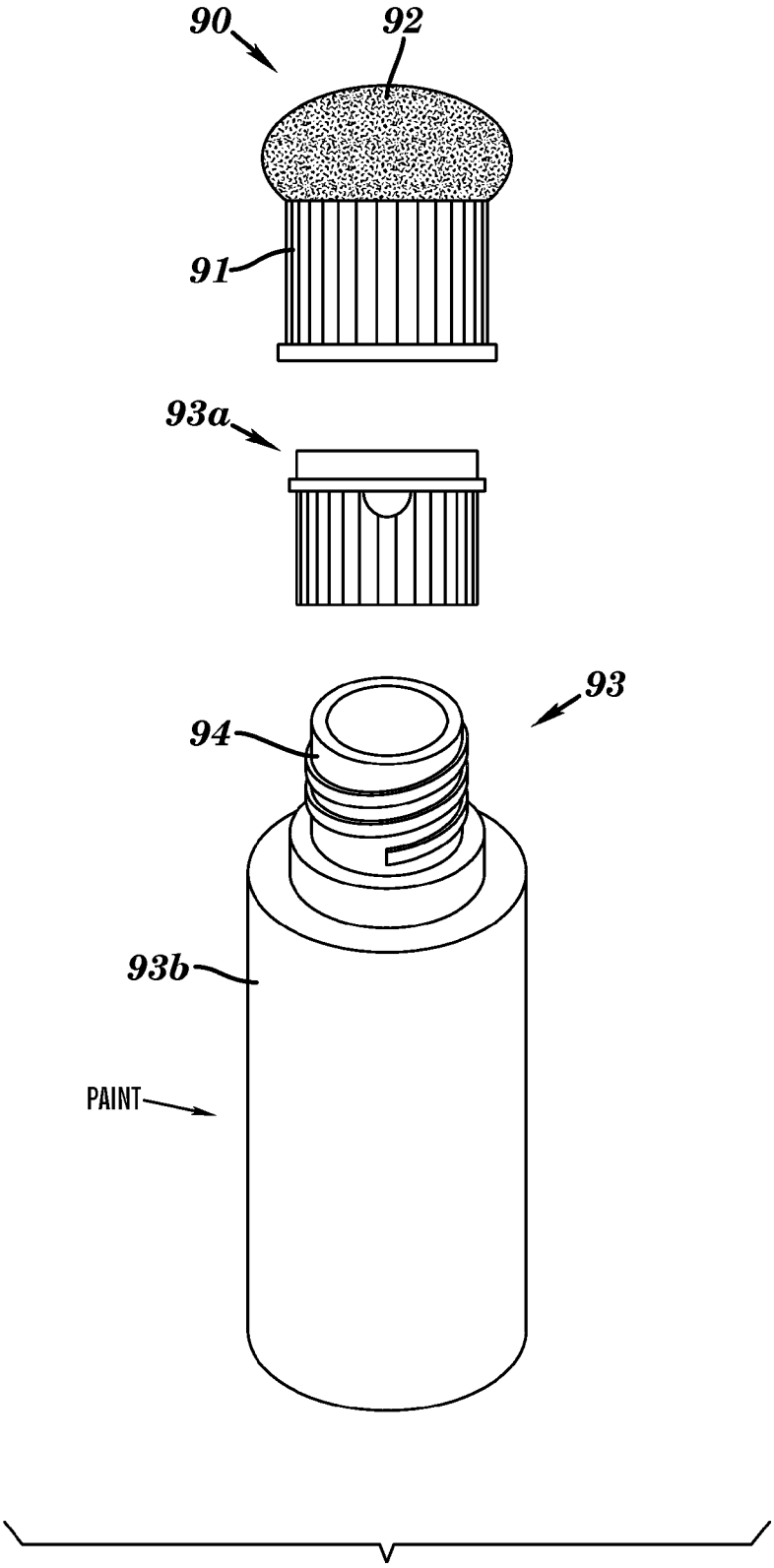
FIG. 13 is an illustration of a paint bottle, paint bottle cap, and foam applicator cap that can be used with the self-aligning stencil device of the present invention.
Figure 14:
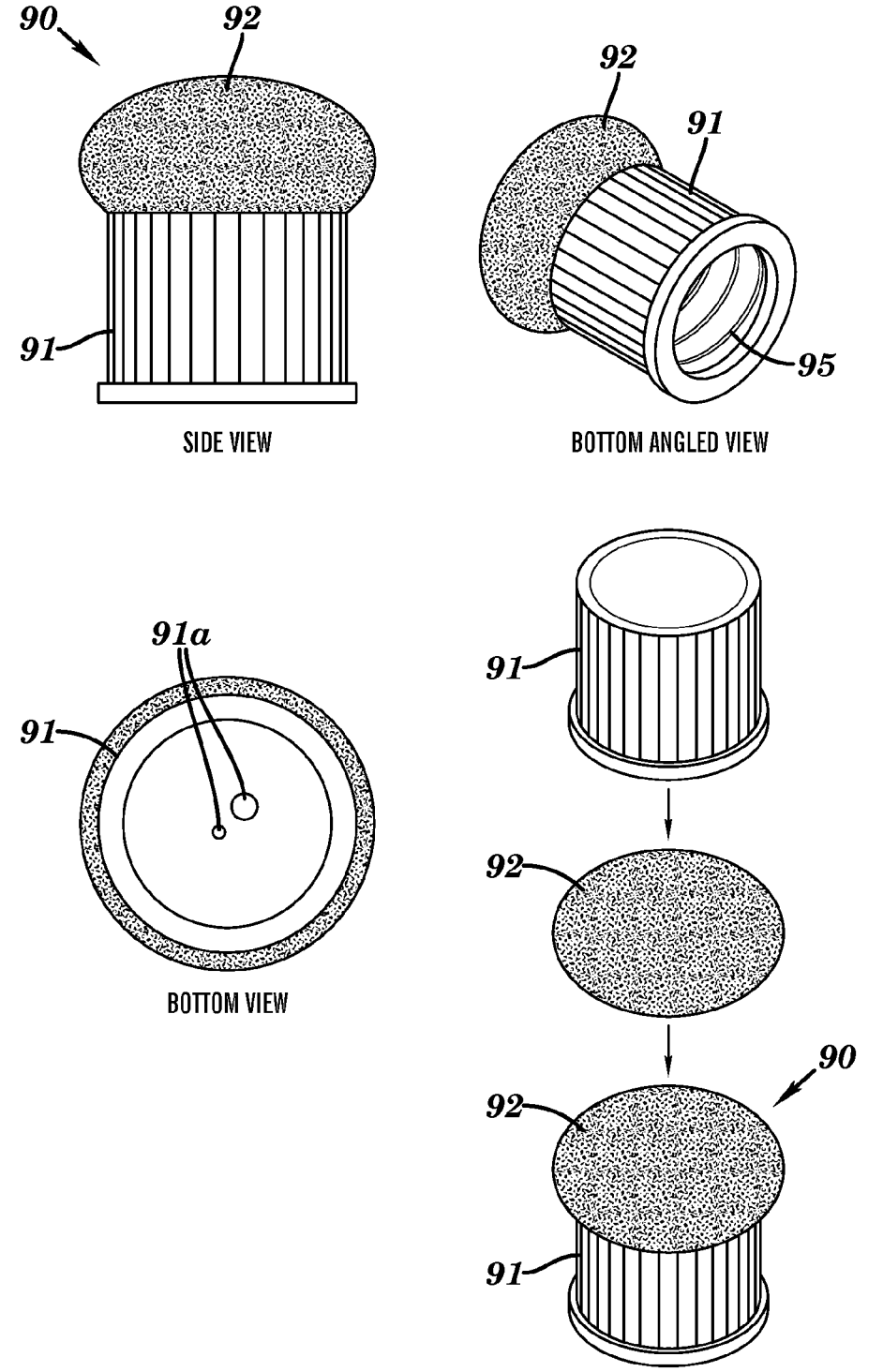
FIG. 14 are illustrations of various views of a foam applicator cap that can be used with the self-aligning stencil device of the present invention. A side view, bottom view, and bottom angled view are shown of the foam applicator cap. Also shown are the separate components of the foam applicator cap prior to assembly.

As shown in FIG. 11A, one embodiment of the stencil device of the present invention can include color-coded instructions on the stencil panels. In such an embodiment, the instructions may be provided on the stencil panels in the form of colored numbers. These instructions inform the user of the order in which the stencil panels are to be folded and which color of paint is to apply to the stencil panel. For example, a stencil panel having a number "1" contained within a yellow circle would instruct the user to fold that stencil panel down first and apply a yellow paint to the stencil. Turning to the embodiment shown in FIG. 11A, the user sees that Step 1 in the instructions is in a yellow circle. The user also sees that flap 1 (e.g., stencil panel 1) is also in a yellow circle. The paint that would be recommended is also yellow. With these color-coordinated instructions and flaps, the user would not be required to read the instructions in order to complete the stencil. Instead, the user would only need to follow the colors on each stencil in the order provided.

Built-In Additional Text (e.g., educational information):

Also as shown in FIG. 15B, an educational description or general information on the subject matter of the stencil can be built-in to the instruction flap, therefore teaching the user about the image that is being stenciled (e.g., for a tropical frog stencil, the educational text can state that the tropical frog is native to South America and its poison has been used on arrows and darts by natives for hunting).

Self-Packaging Design:

As shown in FIG. 15K, the stencil device can be configured to fold upon itself and be locked closed with a self-adhesive tab, with a depiction of the actual stencil on the cover and visible step by step instructions on the back.

Self-Leveling Feature:

In one embodiment, the stencil device of the present invention can include, a self-leveling feature. This feature allows the user to position the device on a wall or other vertical surface at a particular angle. For example, assume that the user is stenciling a series of diamond shapes and wants them to be perfectly vertical. The stencil device could have a built in fluid level, simple clinometer, LCD level, or the like that would allow the user to repeat a specific angle with accuracy.

Shading Method:

In one embodiment of the method of using the stencil device of the present invention (as described further herein), after the user has completed the stenciling of each flap, the sequence can be repeated to add shading and highlights to further enhance the artwork.

Allover Pattern:

The self-leveling aspect of the stencil of the present invention can be used as part of a single overlay, interlocking allover pattern series which allows the user to stencil a repetitive pattern such as a Damask, without the need to layout the room or walls with a vertical reference or repeat reference.

Applicator Cap for Applying Paint:

Another aspect of the present invention relates to the use of a dense foam applicator cap (see FIGS. 12A-12C, 13, and 14). This cap can be retrofit for the standard 2-ounce craft paint bottles. There could be different size foam tips (e.g., small, medium, and large). The present invention also contemplates a kit that could include paints fitted with the applicator tips. This would eliminate the need to purchase paints and brushes separately, which makes the initial purchase easier, and simplifies the painting/stenciling experience.

Applicator Cap for Cleaning a Used Stencil:

In another embodiment, the present invention also provides a retrofit applicator tip configured to include a slightly abrasive surface. As an example, this embodiment can be used for bottles containing a stencil cleaning solution. Such an embodiment would allow the user to clean a dirty stencil by rubbing the stencil with the applicator tip (e.g., by rubbing the stencil in a circular manner).

Packaging:

The stencil device of the present invention can also be packaged or grouped into sets. Some examples can include, without limitation, a butterfly set, a planet set, an outer space set, a furry critter set, etc. These stencil sets could be used to decorate a room, create a mural, make greeting cards, or be provided as a party pack for kids birthdays and such.

Although preferred embodiments have been depicted and described in detail herein, it will be apparent to those skilled in the relevant art that various modifications, additions, substitutions, and the like can be made without departing from the spirit of the invention and these are therefore considered to be within the scope of the invention as defined in the claims which follow.

What is claimed is:

1. A self-aligning stencil device for producing a multi-color composite image on a target surface, said device comprising:

a central panel comprising a solid region and a cut-out region, wherein the solid region comprises a front surface and a back surface and is defined by an outer border of the central panel and an inner border of the central panel, and wherein the cut-out region is vacant space defined by the inner border of the central panel;

a plurality of stencil panels, each stencil panel having its own distinct stencil pattern and being foldably connected to a different corresponding portion of the outer border of the central panel, thereby forming a connection fold between each stencil panel and its corresponding portion of the outer border of the central panel, wherein the plurality of stencil panels, when folded at their connection folds upon the central panel, self-align to collectively form a composite image, so that painting each distinct stencil pattern with a different color is effective to yield a multi-color composite image on a region of the surface imposed behind the cut-out region of the central panel;

a leveling component securely or removably attached to the central panel, wherein said leveling component is configured to identify a level position of the central panel relative to a horizontal plane; and leveling component cut-out regions forming a vacant area on each stencil panel, wherein the leveling component cut-out regions are strategically placed to allow the leveling component to protrude therethrough when each stencil panel is folded onto the central panel.

2. The stencil device according to claim 1, wherein the stencil pattern of each stencil panel is configured so that the multi-color composite image produced by painting each stencil pattern is also multi-layered.

3. The stencil device according to claim 1, wherein at least two of the stencil patterns are configured to have overlapping regions so that the multi-color composite image produced by painting each stencil pattern is shaded due to the mixing of colors.

4. The stencil device according to claim 1, wherein the outer border and inner border of the central panel are of the same or different shape, said shape being selected from the group consisting of a circle, an oval, an oblong shape, a triangle, a diamond shape, a star, a square, a rectangle, a pentagon, a hexagon, an octagon, and an irregular shape.

5. The stencil device according to claim 1, wherein each stencil panel is of the same or different shape as one another and of the same or different shape as the outer border of the central panel, said shape being selected from the group consisting of a circle, an oval, an oblong shape, a triangle, a diamond shape, a star, a square, a rectangle, a pentagon, a hexagon, an octagon, and an irregular shape.

6. The stencil device according to claim 1, wherein said plurality of stencil panels comprises 2, 3, 4, 5, 6, or 8 different stencil panels.

7. The stencil device according to claim 1, wherein the stencil panels are foldably connected to the central panel with or without an adapter.

8. The stencil device according to claim 7, wherein the adapter is configured to function as a hinge mechanism between the stencil panel and the central panel.

9. The stencil device according to claim 1, wherein the portion of the outer border of the central panel that forms the connection fold with the stencil panel is either curved or straight.

10. The stencil device according to claim 1 further comprising:

an attachment component for removably securing the central panel in a desired position on a surface, wherein said attachment component is indirectly or directly attached to the central panel.

11. The stencil device according to claim 10, wherein the attachment component comprises an adhesive material or an abrasive material topically disposed on at least a portion of the back surface of the central panel, said adhesive material or abrasive material being configured to temporarily secure the central panel in place on the target surface.

12. The stencil device according to claim 11, wherein the adhesive material or abrasive material is effective to temporarily secure the central panel on a vertical surface, on a horizontal surface facing upward, on a horizontal surface facing downward, or any other surface at any other planar angle.

13. The stencil device according to claim 10, wherein the attachment component comprises a securing panel foldably connected to the upper most portion of the outer border of the central panel, and wherein the securing panel comprises an outer surface and an opposing inner surface that folds toward the central panel.

14. The stencil device according to claim 13, wherein securing panel is of the same or different shape as the plurality of stencil panels or the central panel, said shape being selected from the group consisting of a circle, an oval, an oblong shape, a triangle, a diamond shape, a star, a square, a rectangle, a pentagon, a hexagon, an octagon, and an irregular shape.

15. The stencil device according to claim 13, wherein the securing panel further comprises:

a locking component configured to lock the plurality of stencil panels and the securing panel in place when all such panels are folded upon the central panel.

16. The stencil device according to claim 13, wherein the securing panel further comprises:

instructions for using the stencil device, wherein said instructions are disposed on at least a portion of the inner surface of the securing panel, so that such instructions are visible when the securing panel is not folded upon the central panel.

17. The stencil device according to claim 16, wherein the securing panel is made of a waterproof material so that the instructions, when exposed to moisture, maintain their visibility.

18. The stencil device according to claim 1, wherein the central panel further comprises:

placement components for securing each stencil panel in place when said stencil panel is folded upon the central panel.

19. The stencil device according to claim 18, wherein said placement components comprise low-tack adhesive tabs.

20. The stencil device according to claim 1, wherein said central panel and said plurality of stencil panels are made of a paint repelling material that is effective to repel the adhesion of paint.

21. The stencil device according to claim 20, wherein said paint repelling material is polypropylene.

22. The stencil device according to claim 1, wherein said leveling component is selected from the group consisting of a bubble-in-liquid level, a clinometer, and an LCD level.

23. The stencil device according to claim 1 further comprising:

color-coded instructions on each stencil panel, said instructions effective to instruct a user on the order and color of paint to use for each stencil panel.

24. The stencil device according to claim 23, wherein said color-coded instructions comprise color-coded numerals in sequential order, signifying the color and order for painting each stencil panel.

25. A kit for producing a multi-color composite image on a target surface, said kit comprising:

a self-aligning stencil device according to claim 1; and painting supplies for use in applying paint to a surface.

26. The kit according to claim 25, wherein said painting supplies comprise a plurality of paints of different colors.

27. The kit according to claim 26, wherein each different color of paint corresponds to a single stencil panel of the stencil device.

28. The kit according to claim 25, wherein said painting supplies comprise at least one paintbrush and/or at least one paint roller and a plurality of paints of different colors.

29. The kit according to claim 25 further comprising:

at least one foam applicator cap suitable for attaching to a paint bottle and for applying paint to a surface.

30. The kit according to claim 25 further comprising:

at least one additional self-aligning stenciling device that is effective to produce a final image different from the original stenciling device.

31. The kit according to claim 25 further comprising:

a plurality of cards that are suitable for applying paint thereto.

32. The kit according to claim 25 further comprising:

a container suitable for holding the contents of the kit.

33. The kit according to claim 25 further comprising:

a stencil cleaning solution.

34. The kit according to claim 25 further comprising:

an abrasive stencil cleaning tip for attaching to a stenciling cleaning solution bottle, wherein the abrasive stencil cleaning tip is effective for facilitating application of a stencil cleaning solution and removal of paint on a stencil panel.

35. The kit according to claim 25 further comprising:

a leveling component.

36. A method of producing a multi-color composite image to a target surface, said method comprising:

(1) providing a self-aligning stencil device according to claim 1;

(2) temporarily securing the central panel, either directly or indirectly, to a target surface to which the multi-color composite image is to be produced thereon, so that each of the stencil panels is in an unfolded position;

(3) applying paint to the target surface using a first stencil panel as follows:

(i) folding a first stencil panel onto the central panel;

(ii) applying a first paint color to the surface as defined by the first stencil panel; and (iii) unfolding the first stencil from the central panel;

and (4) repeating step (3) for each of the remaining stencil panels until the desired final multi-color image is produced on the surface.

37. The method according to claim 36 further comprising:

prior to performing step (3), applying a background paint to the surface as defined by the cut-out region of the central panel.

38. The method according to claim 36 further comprising:

repeating steps (3) and (4) for at least one of the stencil panels in order to produce a shading and/or highlighting effect on the final image, wherein said repeating may be done using the same or a different color of paint as originally used for the subject stencil panel.

39. The method according to claim 36, wherein step (3)(i) comprises temporarily securing the stencil panel in place for the paint application step (3)(ii).

40. The method according to claim 36, wherein the multi-color image is applied to a surface selected from the group consisting of a vertical surface, a horizontal surface facing upward, a horizontal surface facing downward, and any other surface at any other planar angle.

41. The method according to claim 36, wherein the attachment component comprises a top securing panel, said top securing panel comprising a plane having the same number of edges and substantially the same shape as the central panel, and wherein said top securing panel is foldably connected to a corresponding edge of the central panel.

42. The method according to claim 41 further comprising:

providing instructions for using the stencil device, said instructions being disposed on at least a portion of the inner surface of the top securing panel, so that such instructions are visible when the top securing panel is not folded upon the central panel.

43. The method according to claim 36 further comprising:

providing color-coded numerical instructions positioned on the plurality of stencil panels, thereby instructing a user of the order and color for each stencil panel.

44. The method according to claim 36 further comprising:

using the leveling component of the self-aligning stencil device to assist in temporarily securing the central panel in place at a level position.

* * * * *